US009470006B2

(12) United States Patent
Panseri et al.

(10) Patent No.: US 9,470,006 B2
(45) Date of Patent: Oct. 18, 2016

(54) EQUIPMENT AND METHOD FOR DEMOLISHING A BUILDING

(75) Inventors: Giuseppe Panseri, Scanzorosciate (IT); Stefano Panseri, Scanzorosciate (IT); Roberto Panseri, Scanzorosciate (IT)

(73) Assignee: Despe S.p.A., Torre de' Roveri (IT)

( * ) Notice: Subject to any disclaimer, the term of this patent is extended or adjusted under 35 U.S.C. 154(b) by 101 days.

(21) Appl. No.: 14/352,991

(22) PCT Filed: Oct. 20, 2011

(86) PCT No.: PCT/IB2011/054687

§ 371 (c)(1),
(2), (4) Date: Aug. 4, 2014

(87) PCT Pub. No.: WO2013/057543

PCT Pub. Date: Apr. 25, 2013

(65) Prior Publication Data

US 2014/0360814 A1 Dec. 11, 2014

(51) Int. Cl.

| | |
|---|---|
| ***E04G 23/08*** | (2006.01) |
| ***E04G 3/22*** | (2006.01) |
| ***E04G 3/24*** | (2006.01) |
| ***E04G 3/34*** | (2006.01) |
| *E04G 3/28* | (2006.01) |

(52) U.S. Cl.

CPC ..... *E04G 23/08* (2013.01); *E04G 3/22* (2013.01); *E04G 3/243* (2013.01); *E04G 3/34* (2013.01); *E04G 2003/283* (2013.01); *E04G 2003/286* (2013.01)

(58) Field of Classification Search

CPC ..... E04G 23/08; E04G 3/34; E04G 3/22; E04G 3/243; E04G 2003/283; E04G 2003/286

See application file for complete search history.

(56) References Cited

U.S. PATENT DOCUMENTS 4,979,589 A * 12/1990 Sugiyama et al. ..... 182/38
5,492,197 A * 2/1996 Yonahara ..... 182/83

FOREIGN PATENT DOCUMENTS

| | | | |
|---|---|---|---|
| DE | 9316317 U1 | * | 12/1993 |
| EP | 1403447 A1 | * | 3/2004 |
| JP | 7-54503 A | | 2/1995 |
| JP | 11-6310 A | | 1/1999 |
| JP | 11022200 A | * | 1/1999 |

* cited by examiner

*Primary Examiner* — Alvin Chin-Shue
(74) *Attorney, Agent, or Firm* — Blank Rome LLP

(57) ABSTRACT

An equipment (1) for demolishing a building (2), wherein said building (2) comprises a building base (3) placed in proximity of a ground (4), or placed on the ground (4), and an opposite building top (5) or temporary building top (5) arranged away from said building base (3), as well as building floors (6), comprises: —a platform (7) adapted to be positioned against the top of the building (5) avoiding ground support devices which from the platform (7) reach the base of the building (3) or the ground (4) surrounding the building; said platform (7) comprising at least one working scaffold (8) adapted to be arranged along the periphery (9) of said building (2) and to face at least one floor (6) of said building (2); —said at least one working scaffold (8) being supported, hanged, on said platform (7) so that it descends along the side wall (10) of the building (2) to border the works for demolishing the building (2).

19 Claims, 18 Drawing Sheets

EQUIPMENT AND METHOD FOR DEMOLISHING A BUILDING

The present invention refers to an equipment and a method for demolishing a building, in particular for buildings having a particular extension in height.

It is known that due to the demographic density of some areas, for example the most central areas of towns, buildings are built having a considerable extension in height. These buildings are also known as skyscrapers.

As known, the demolition of these skyscrapers is particularly difficult especially in the case where the building is positioned near adjacent buildings. Actually, demolishing a considerable high building requires constructing a support structure which is near the building and, starting from the base thereof, allows reaching up to the top so as to leave the demolition area free for gradually demolishing the building avoiding interfering with the adjacent buildings.

Thus, there is a special need of finding an equipment and a method for demolishing a building that is not only little invasive and simultaneously quick, but which also allows a total control of the demolition and avoids the fall of debris to the ground.

There is also a special need of providing an equipment and a method for the demolition of buildings which avoids the use of extremely cumbersome or gigantic structures around the base of the building and that avoids using the entire extension in height of the facade, especially when the building is located very close to other buildings.

There is also a special need of making an equipment that is light, but simultaneously robust and stable during the demolition of the building also in case of strong lateral wind or sudden and unexpected earthquakes.

From the document JP11030038 a demolition equipment is known which provides for a structure capable of reaching from the base of the building up to the top thereof. In particular, this solution provides for the use of long feet that are positioned on the ground in proximity of the building to discharge the weight of the demolition structure to the ground and make it structurally independent from the building.

Though satisfactory from various points of view, this solution is however extremely cumbersome on the side of the building, actually preventing the use thereof when the building is positioned near other buildings.

Document JP4146345 shows a structure that is anchored by means of grippers on the side of the building supporting a cover for protecting the demolition worksite. Though capable of leaving the demolition area completely free, this structure is extremely cumbersome and needs buildings having extremely resistant pillars which allow a lateral anchoring to the building and the discharge of the entire weight of the demolition structure on the sides of the pillars. Actually this solution cannot be applied in buildings that do not have an over-dimensioned structure of the pillars and, in this case as well, in extremely windy areas or in areas with high likelihood of earthquake.

Document EP1403447 shows a demolition structure that is anchored to guides firmly fixed to the facades of the building, so as to discharge the weight of the structure on the entire height of the building. This known structure is particularly difficult to mount and use, the guides being particularly difficult to mount with the tolerances required to avoid jamming in the movements of the demolition structure. Thus, this solution is particularly difficult regarding mounting and requires long set-up times.

Document JP11022200 presents a demolition structure anchored to the floor of the building floors. Such structure requires limited weight in order to guarantee the possibility that the floors of the building support the structure even during the demolition. Furthermore, this solution is particularly sensitive to the lateral winds or sudden earthquakes, actually making it unsuitable for many applications.

Therefore, the object of the present invention is to devise a demolition equipment and a demolition method that allow overcoming the drawbacks of the prior art and which simultaneously allow a little invasive, rapid demolition with a total control of the bordering of the demolition operations, while avoiding cumbersome structures so as to leave the base of the building free, and which simultaneously allow overcoming any sudden lateral wind and unexpected earthquakes without drawbacks.

These and further objects are attained by means of an equipment for the demolition of buildings as described in claim 1 attached herein, as well as by a method for the demolition of a building as described in claim 23 attached herein.

Further objects, solutions and advantages are present in the embodiments described hereinafter and claimed in the dependent claims attached herein.

Various embodiments of the invention are described hereinafter through embodiments indicated, solely by way of example and in a non-limiting manner, with particular reference to the attached figures wherein.

Figure 1:
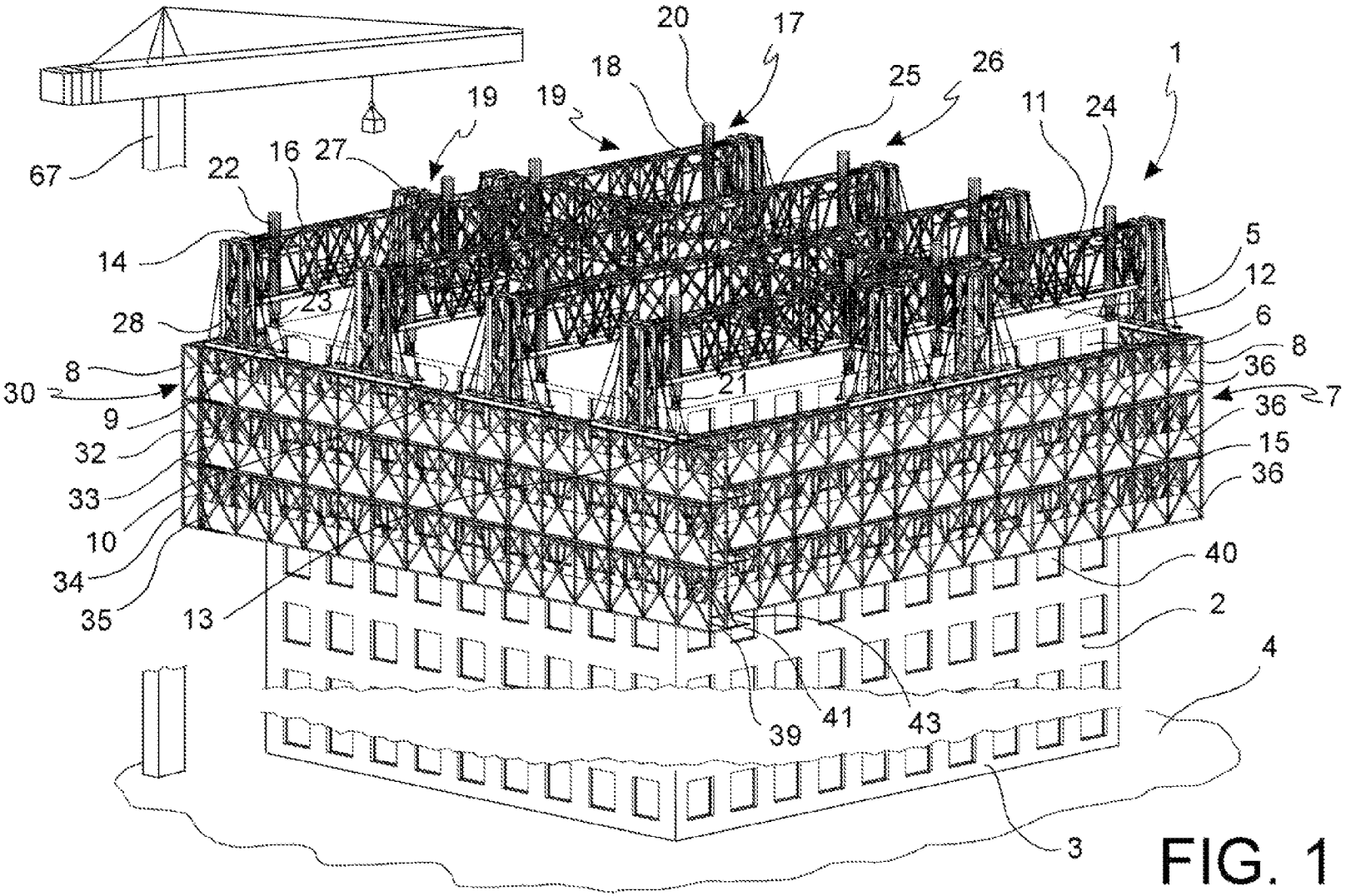
FIG. 1 represents a partially sectioned axonometric view of a building with predominant extension in height, on whose top a demolition equipment is mounted.
Figure 2:
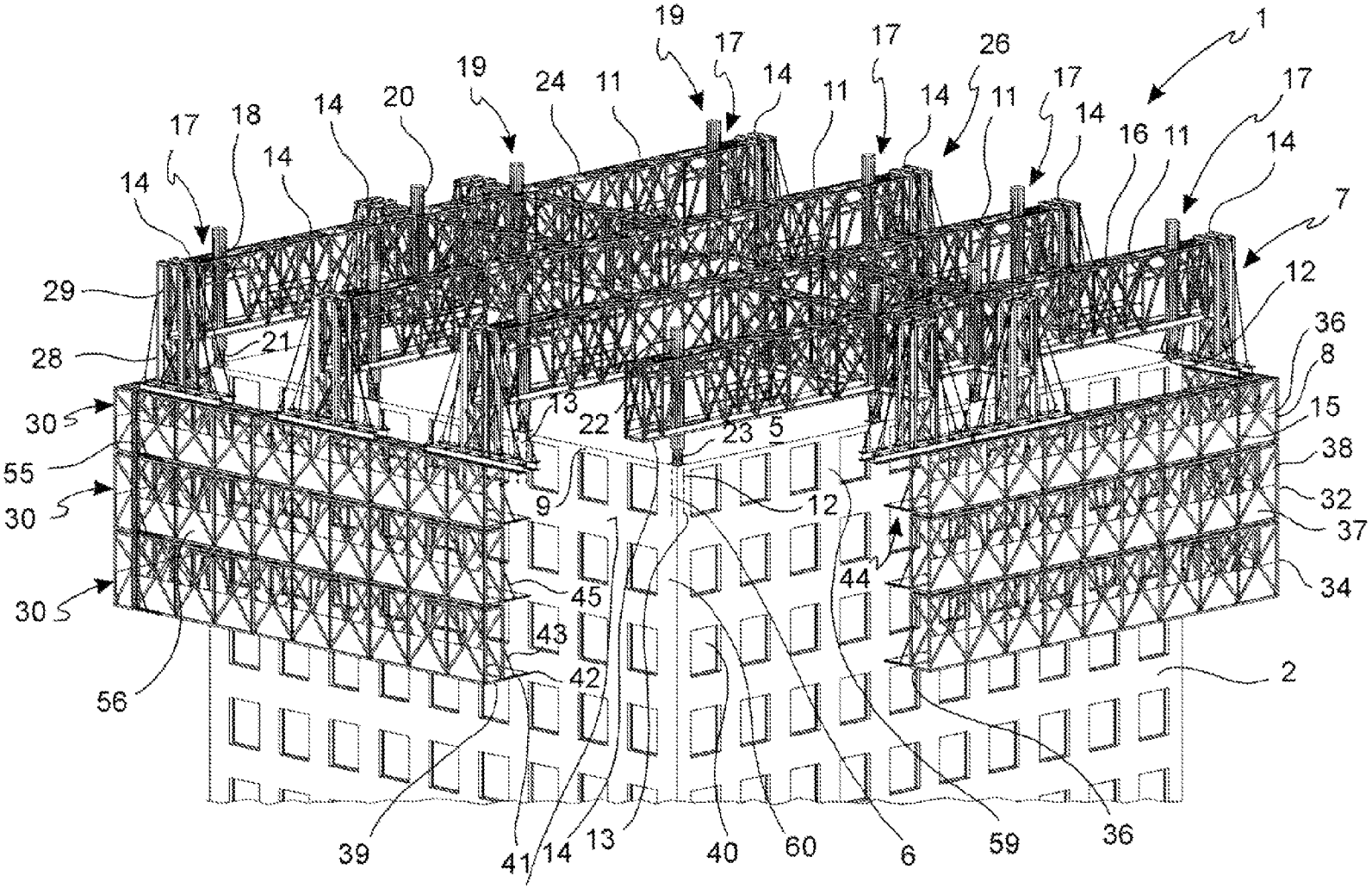
FIG. 2 represents in partially sectioned axonometric view—the equipment of FIG. 1.
Figure 3:
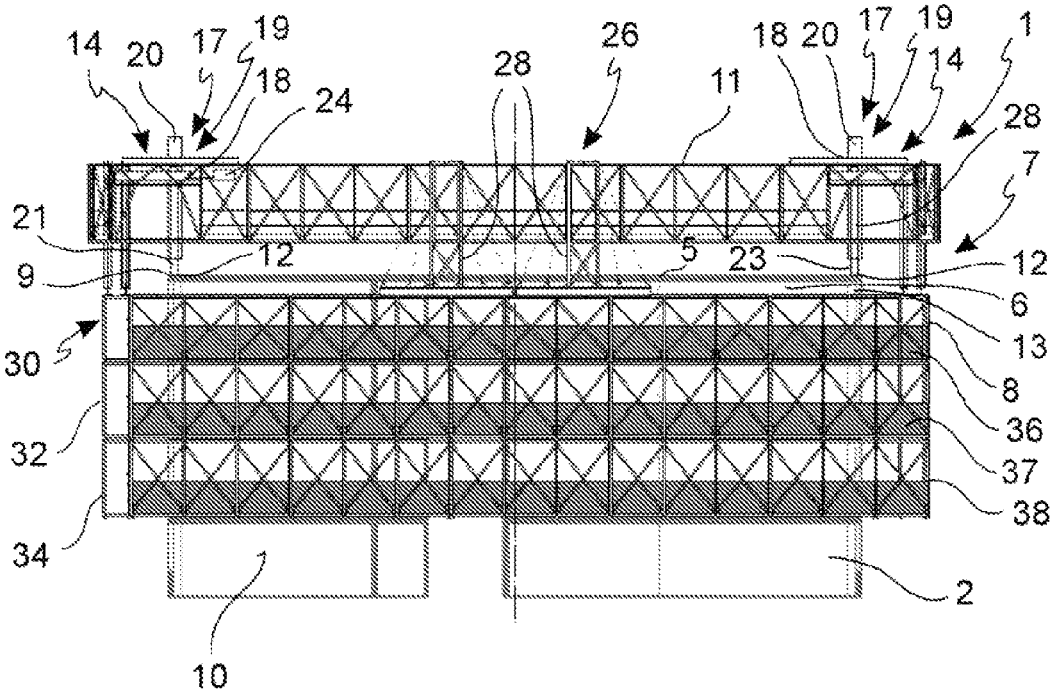
FIG. 3 represents—with a first side view—the equipment of FIG. 1.
Figure 4:
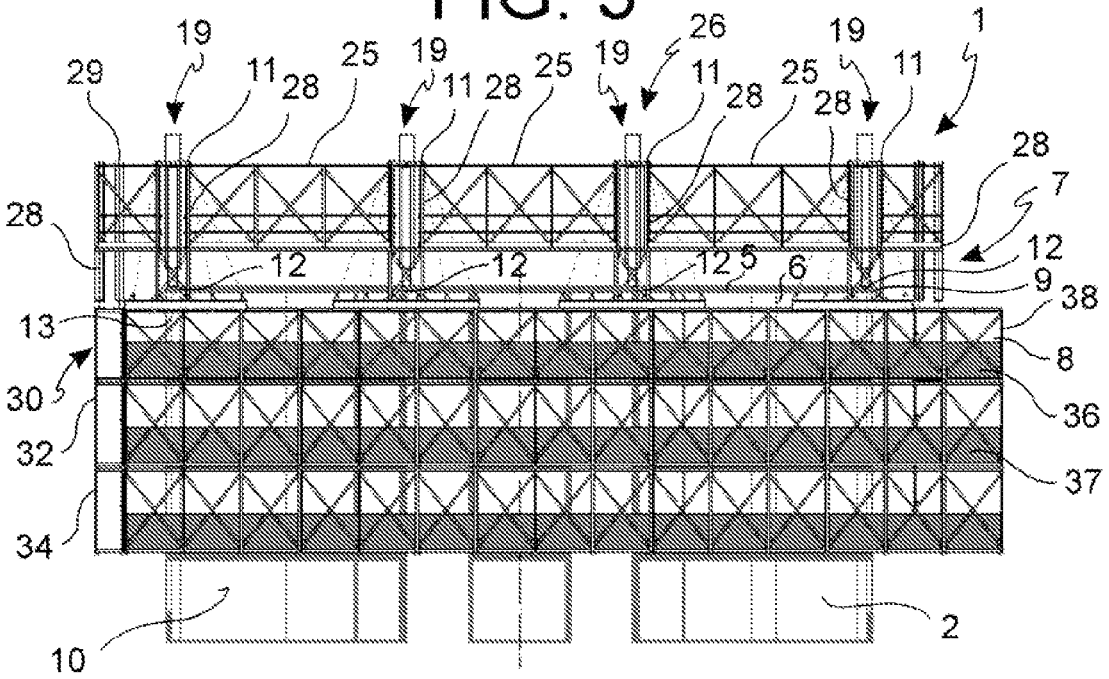
FIG. 4 represents a second side view of the equipment of FIG. 1.
Figure 5:
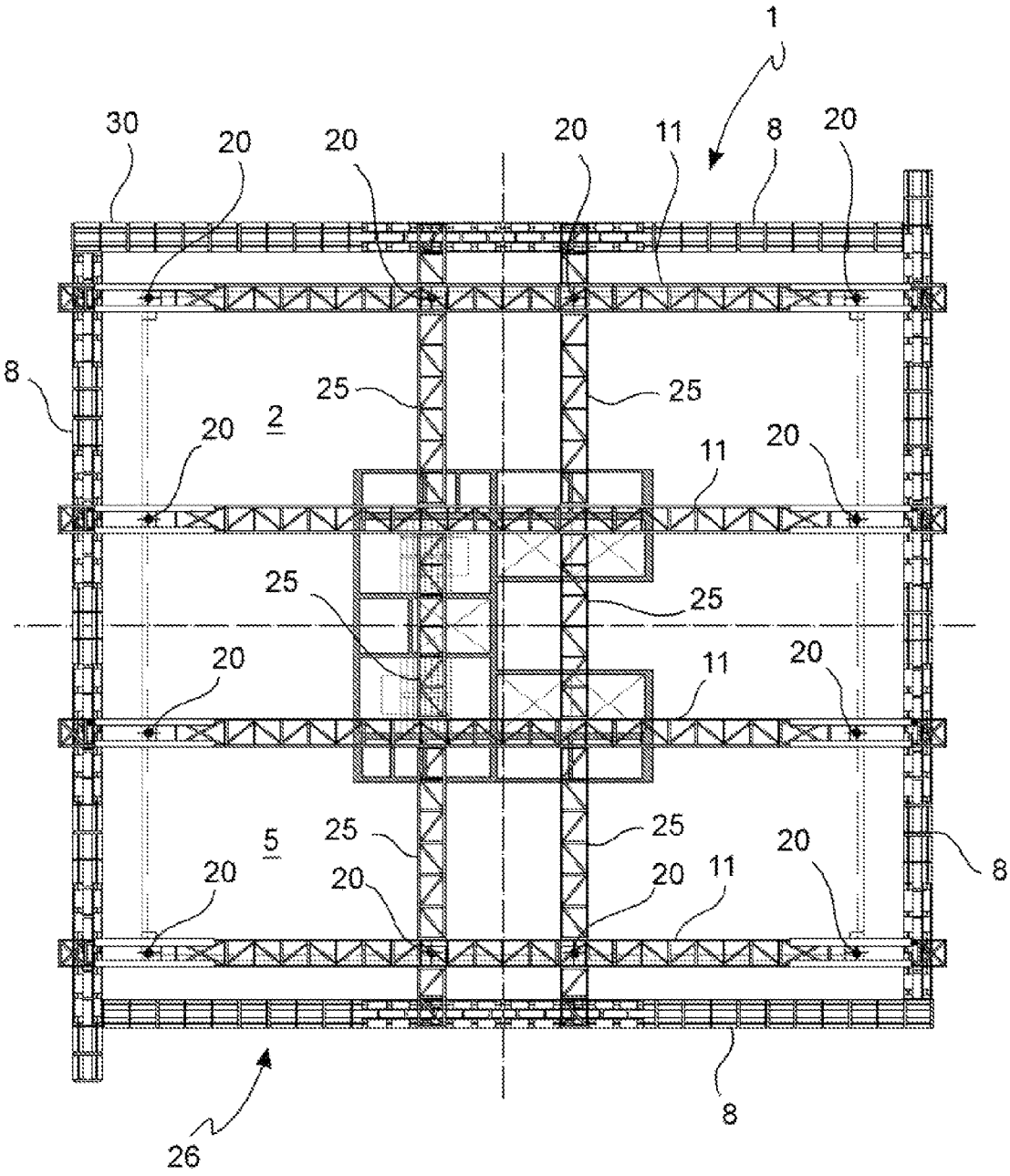
FIG. 5 illustrates a top view of the equipment of FIG. 1.
Figure 6:
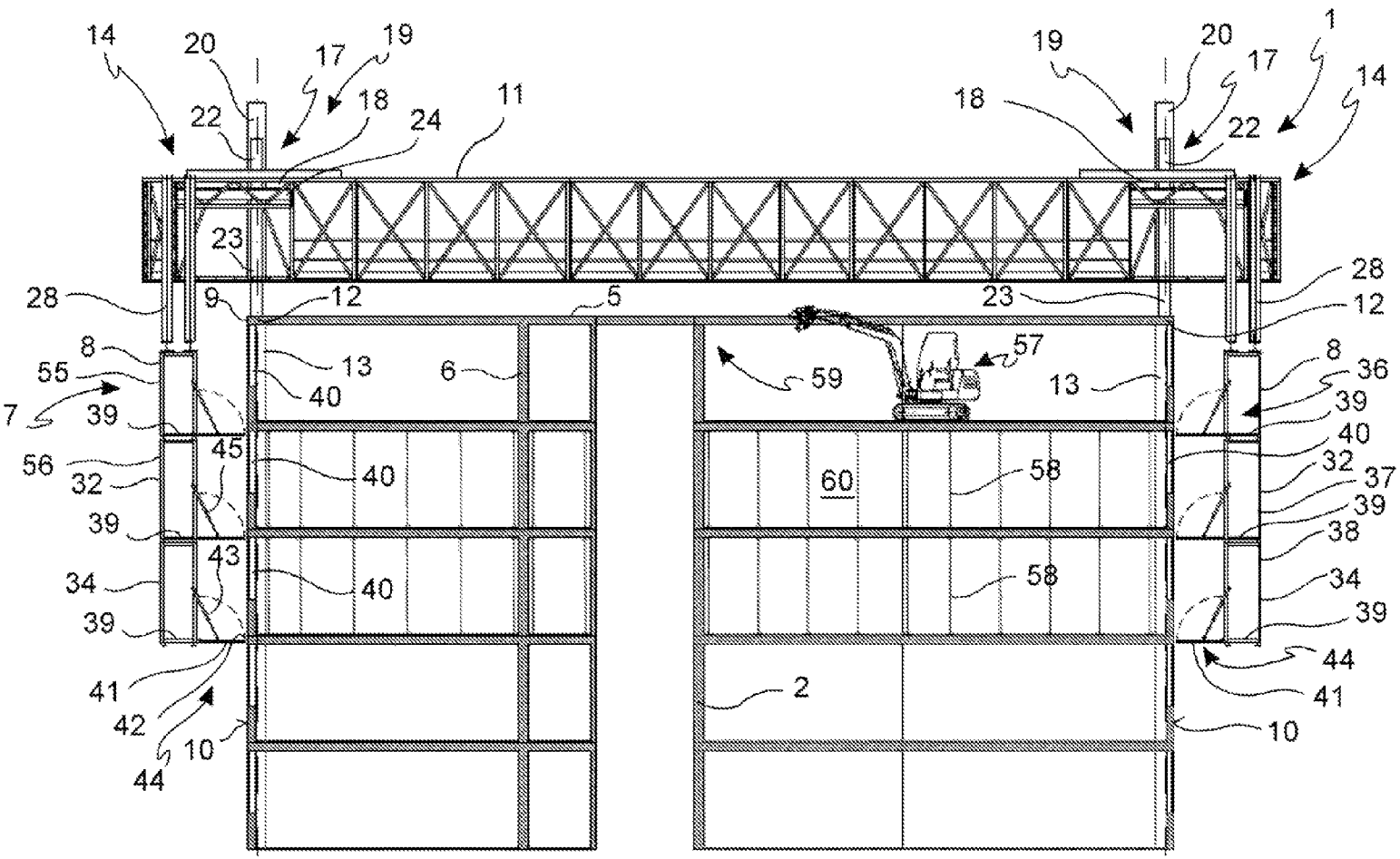
FIG. 6 illustrates a section view of the equipment of FIG. 1.
Figure 7:
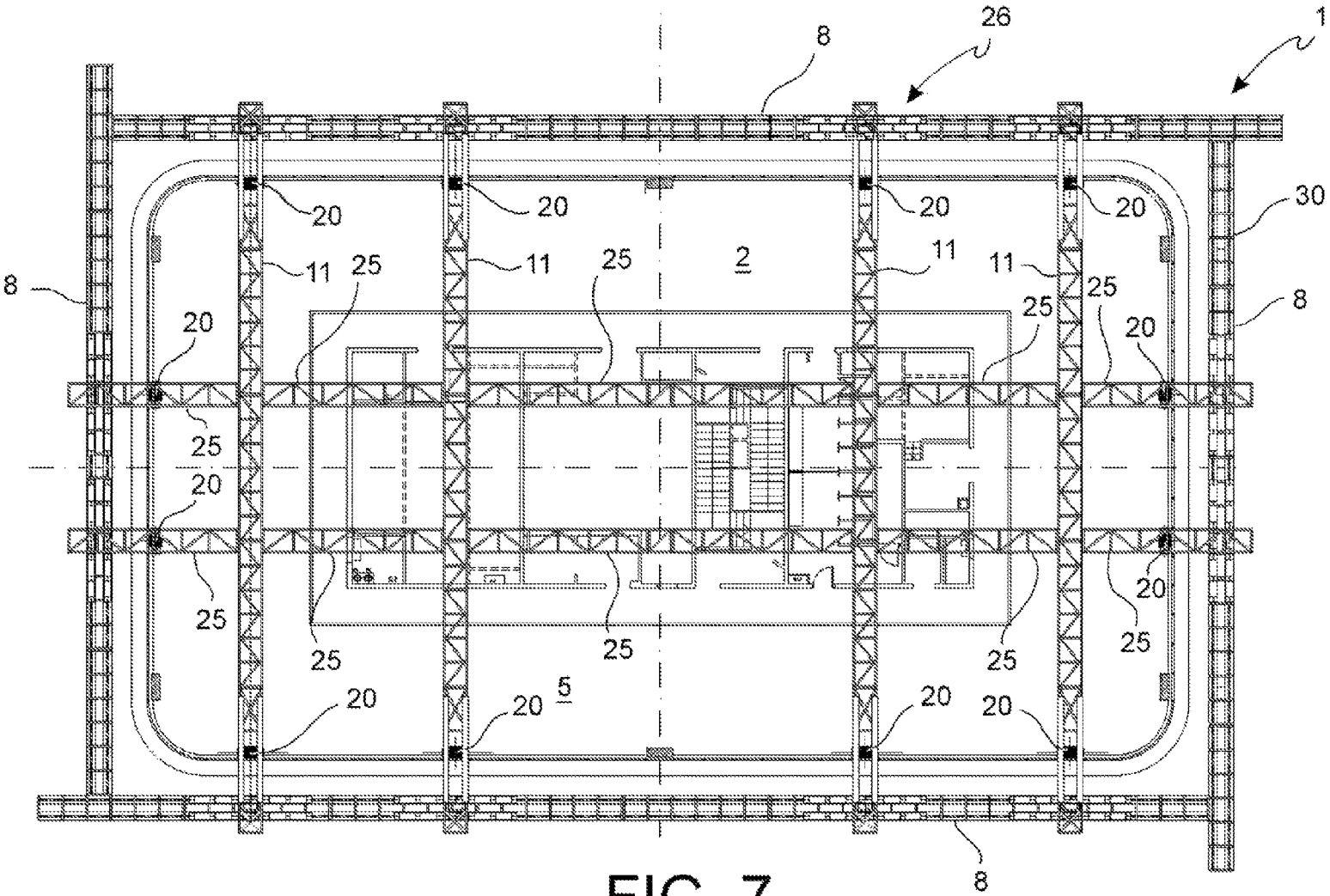
FIG. 7 represents—in top view—an equipment according to a further embodiment.
Figure 8:
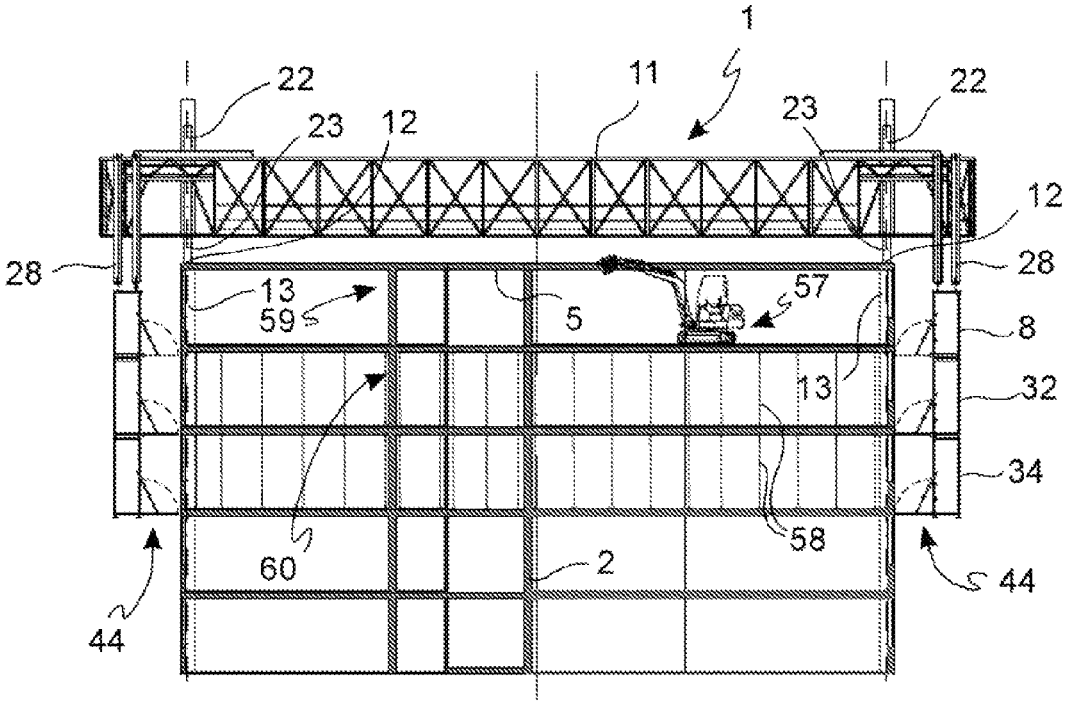
FIG. 8, FIG. 9, FIG. 10, FIG. 11, FIG. 12 and FIG. 13 represent six different steps of using the demolition equipment, as well as six different demolition steps.
Figure 9:
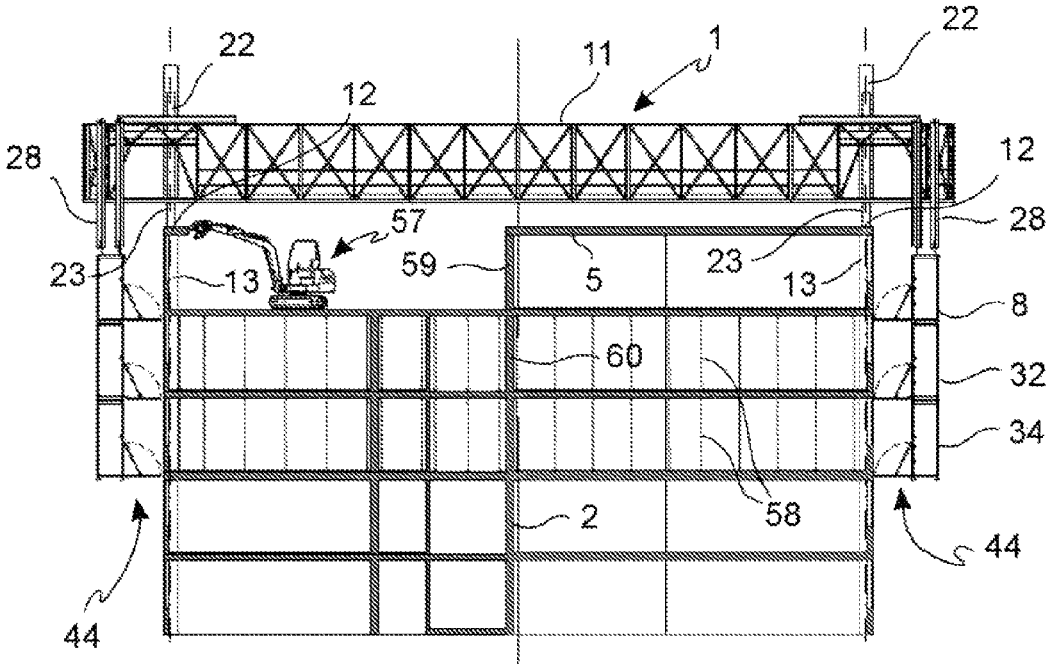
Figure 10:
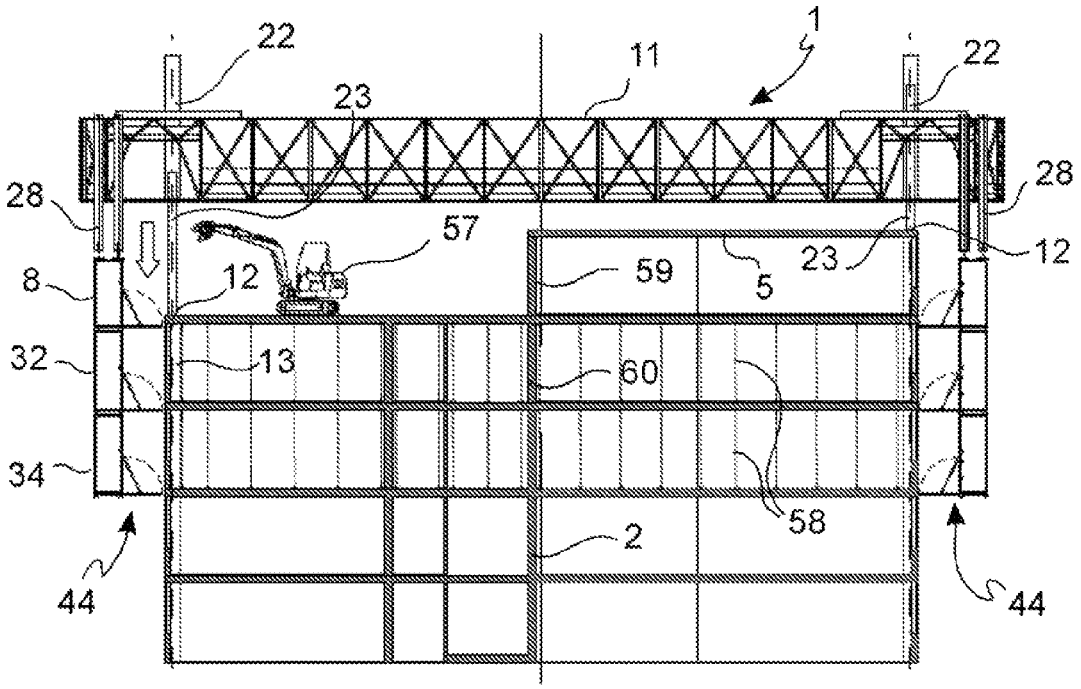
Figure 11:
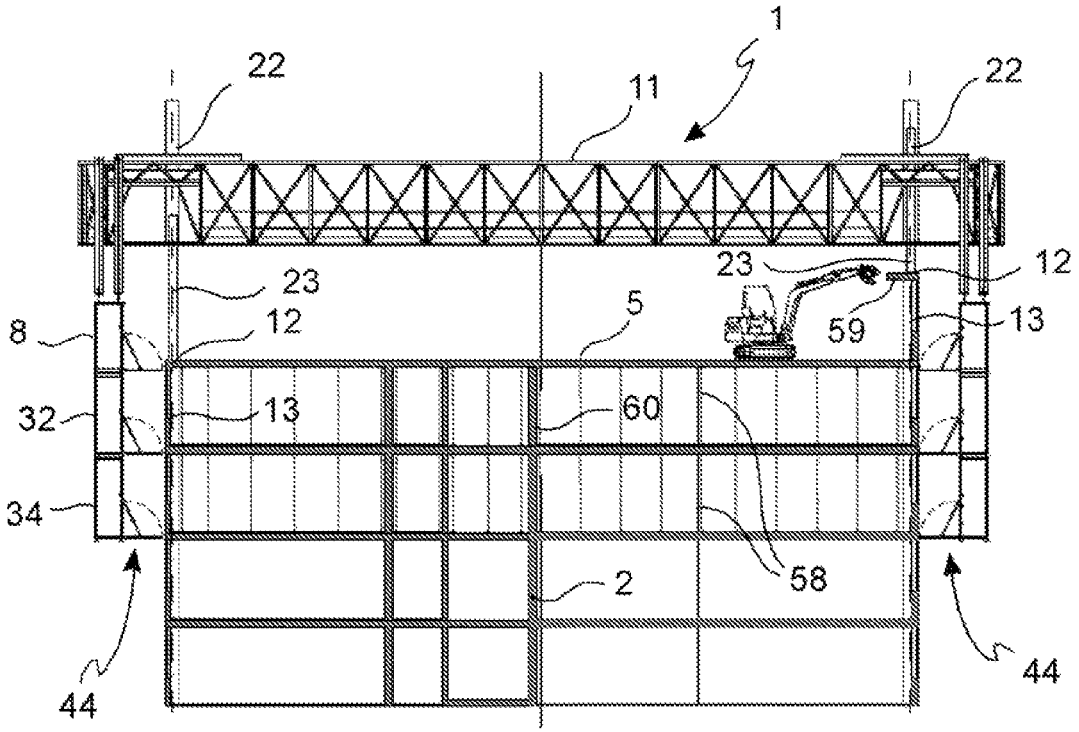
Figure 12:
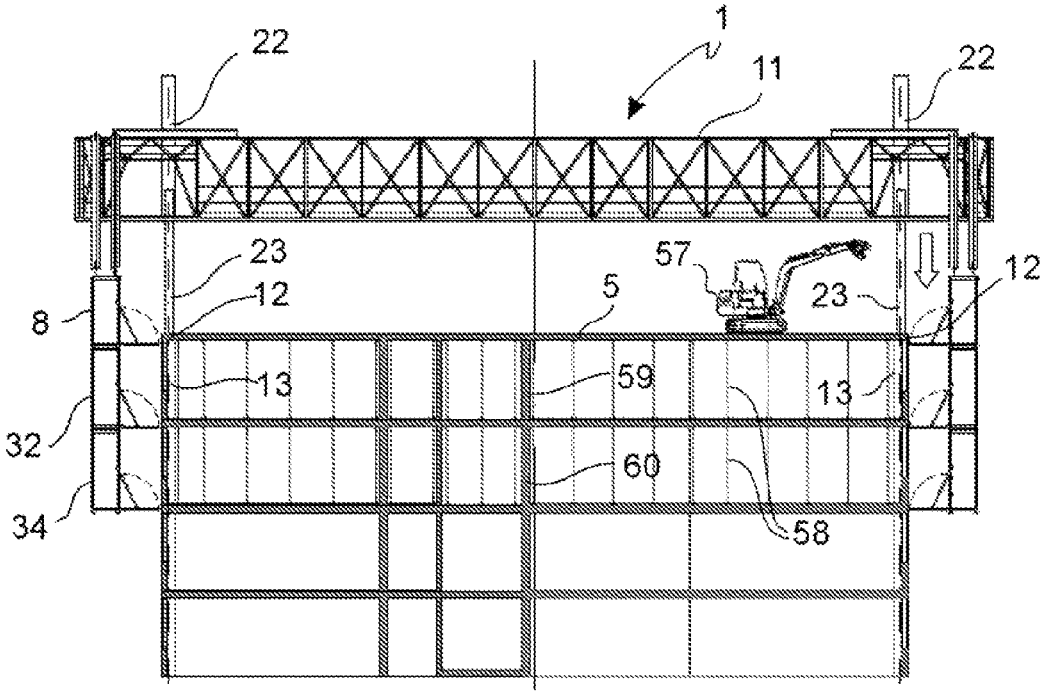
Figure 13:
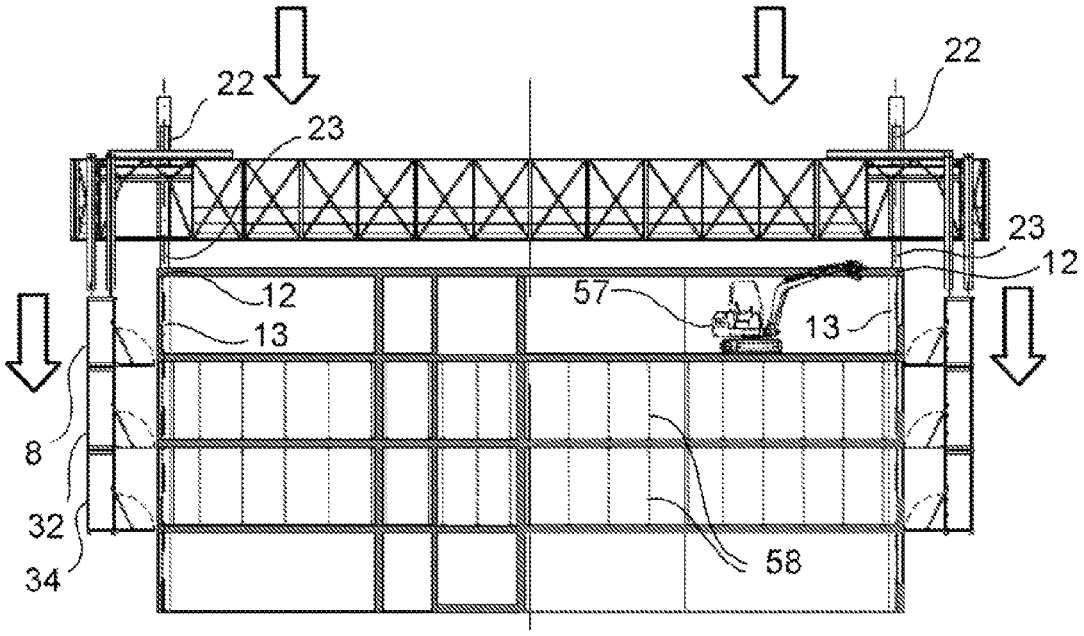
Figure 14:
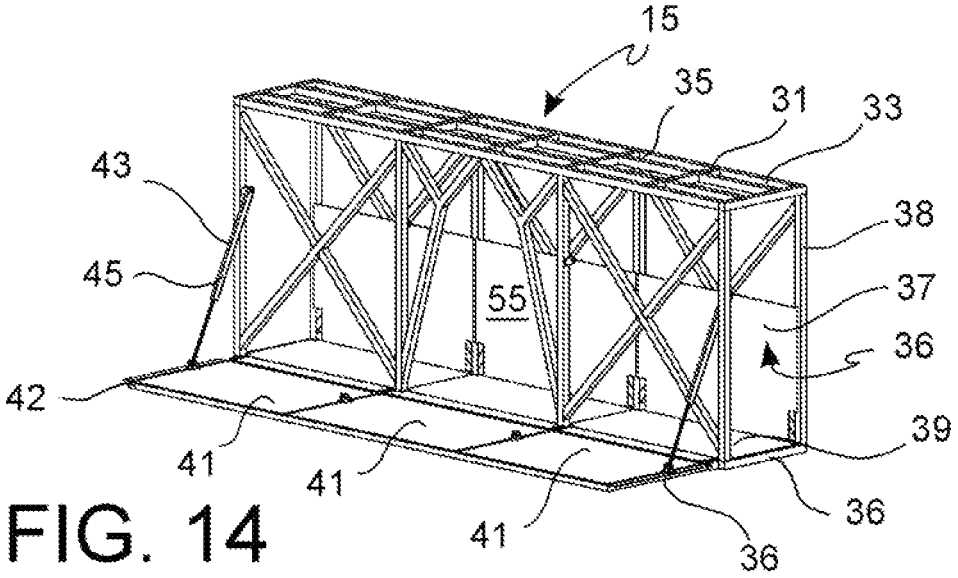
FIG. 14 represents—in axonometric view—a working scaffold module.
Figure 15:
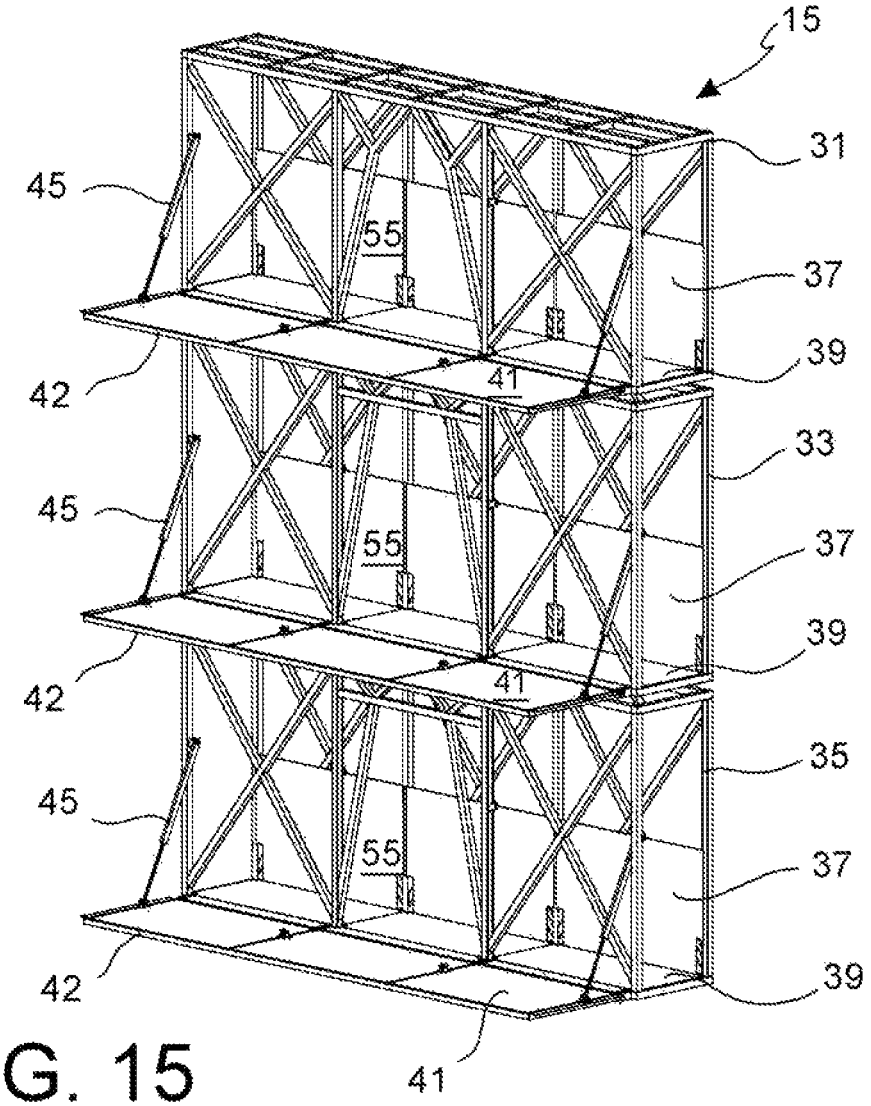
FIG. 15 represents—in axonometric view—three superimposed modules of a working scaffold, a central under-working scaffold and a lower under-working scaffold.
Figure 16:
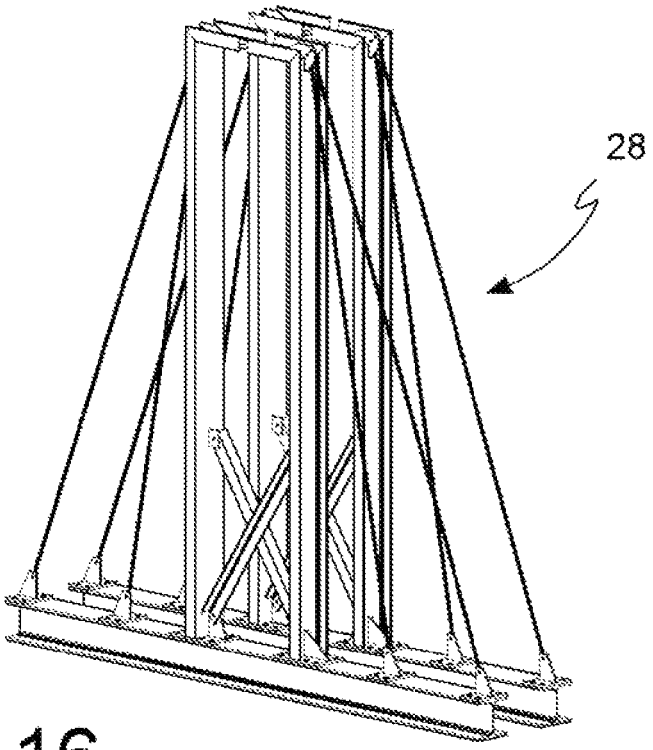
FIG. 16 represents—in axonometric view—a working scaffold suspension module.
Figure 17:
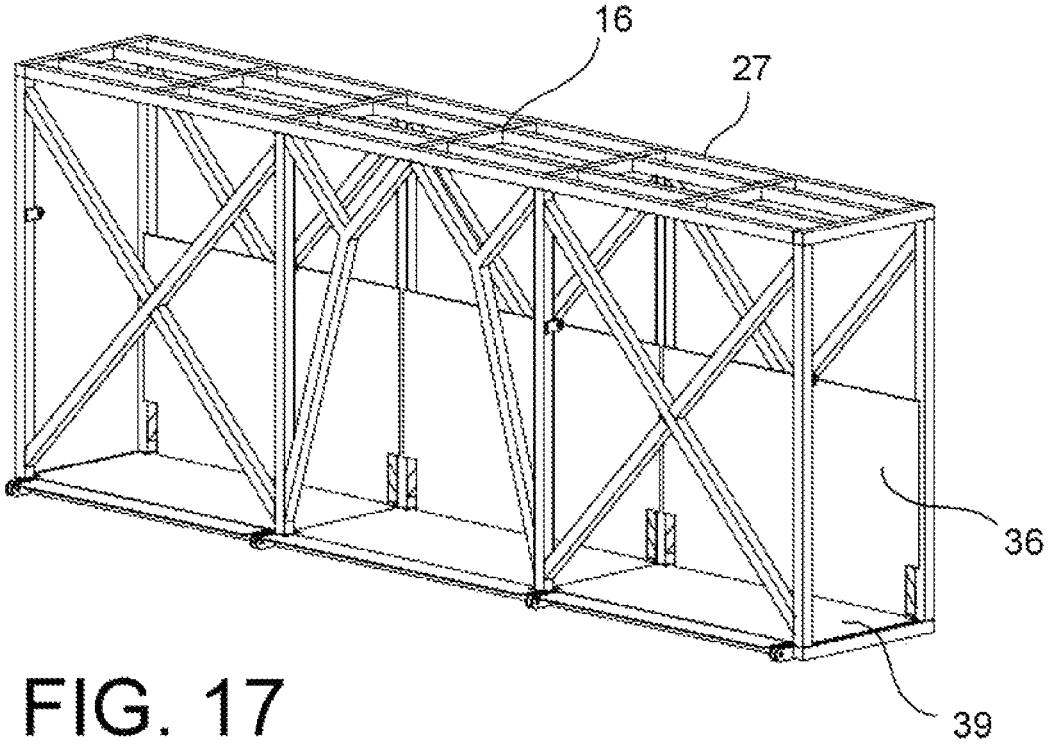
FIG. 17 represents—in axonometric view—a main beam or a connection beam module.
Figure 18:
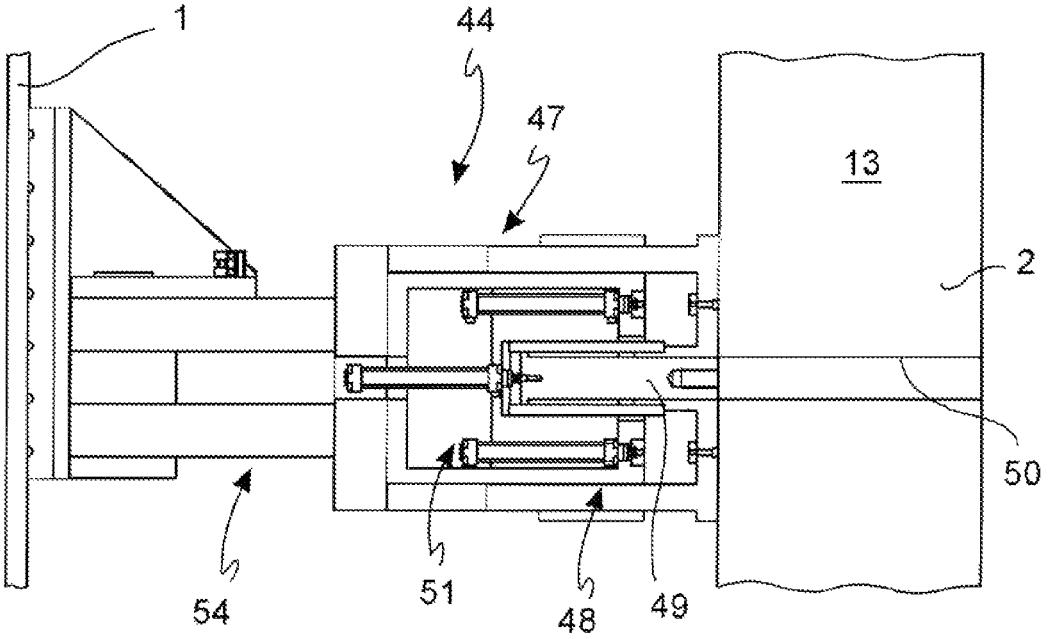
FIG. 18 and FIG. 19 represent two operating steps of a gripper for anchoring to the pillars according to a first embodiment.
Figure 19:
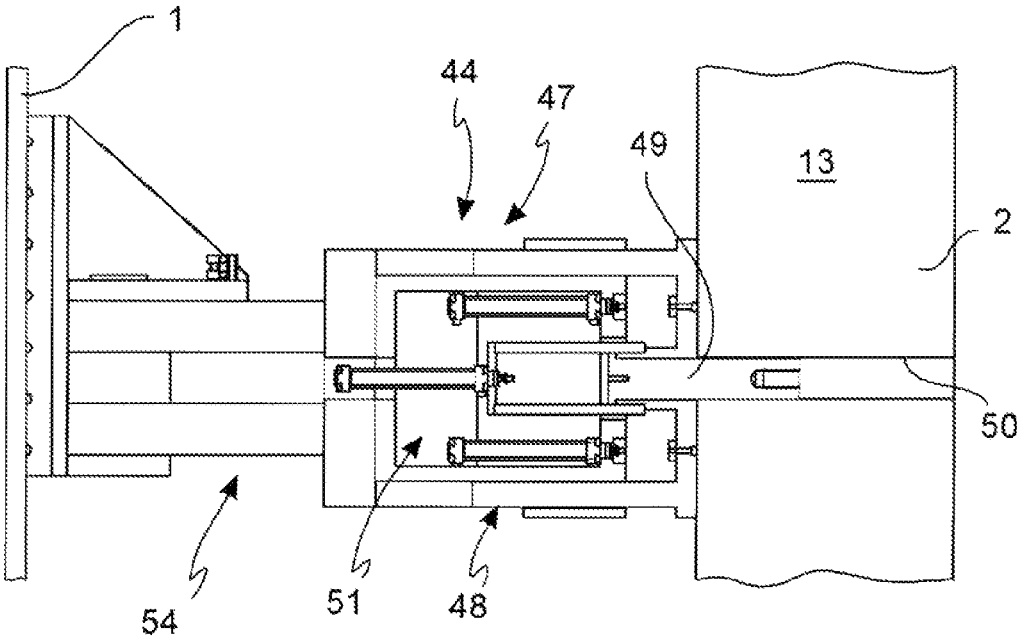
Figure 20:
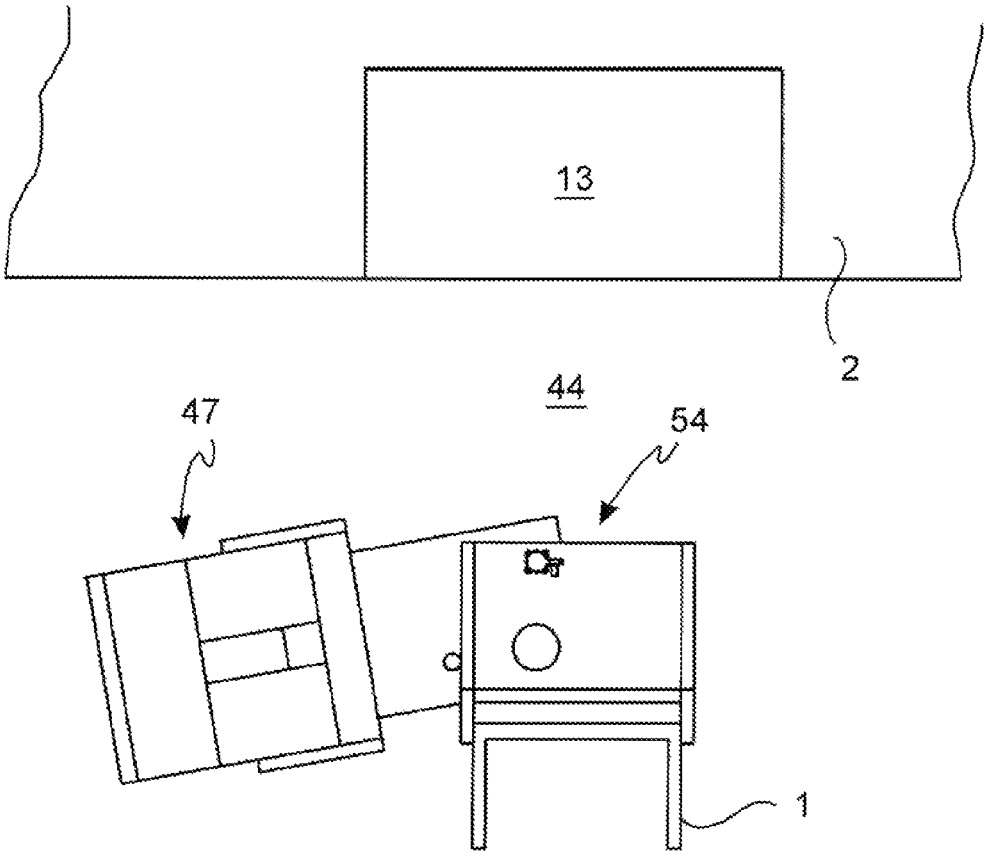
FIGS. 20 and 21 represent a foldable support structure for an anchoring gripper in folded positions moving away from the pillar.
Figure 21:
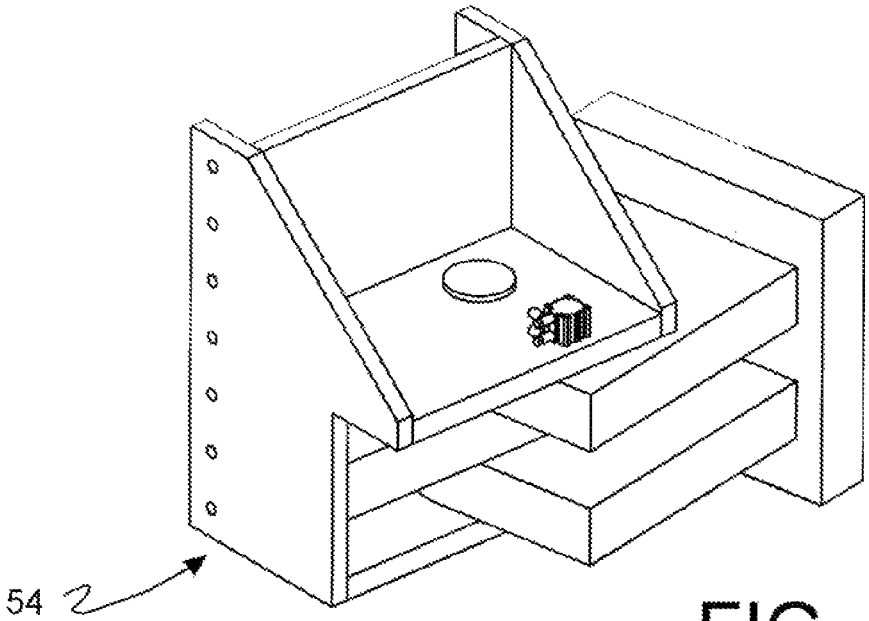
Figure 22:
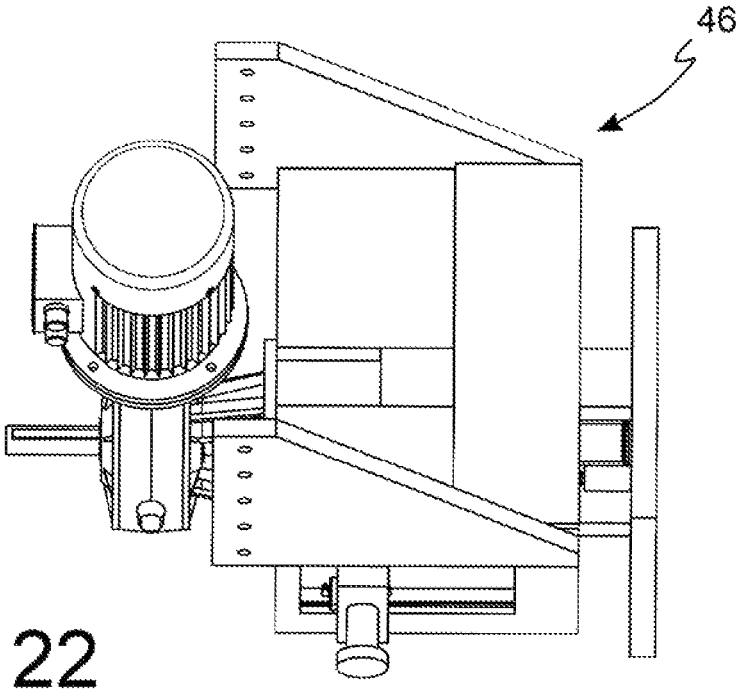
FIG. 22 represents a support piston on the side of the building.
Figure 23:
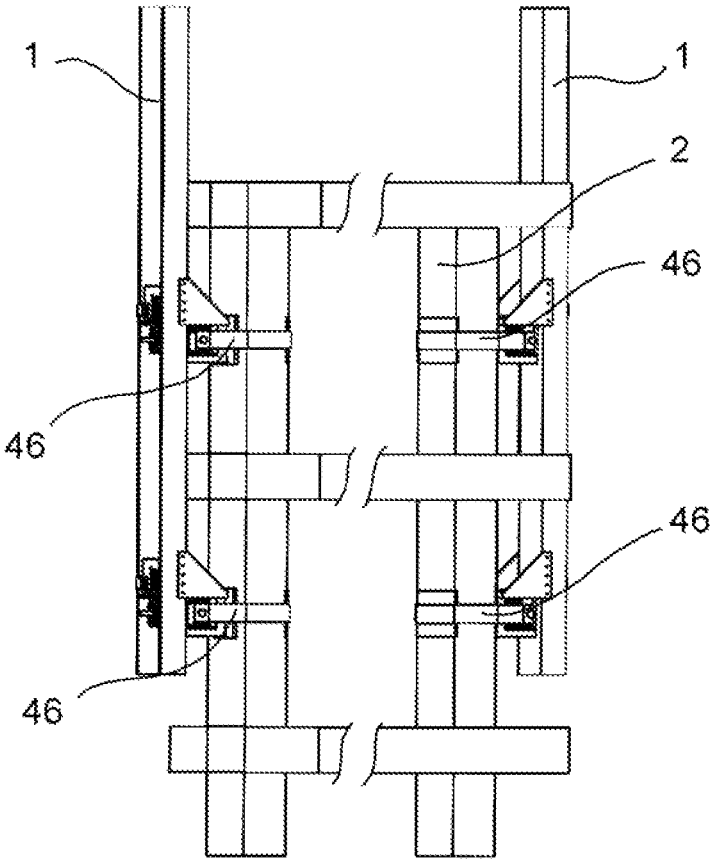
FIG. 23 represents—in partially sectioned side view—a group of support pistons on the side of the building and arranged opposite to each other.
Figure 24:
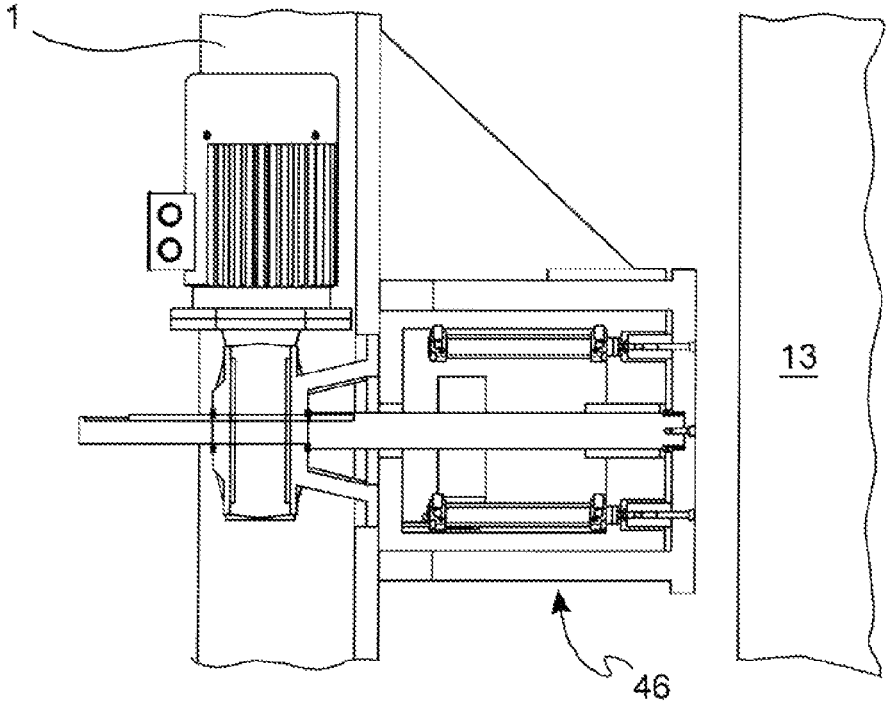
FIGS. 24 and 25 represent two operating steps of a support piston on the side of the building.
Figure 25:
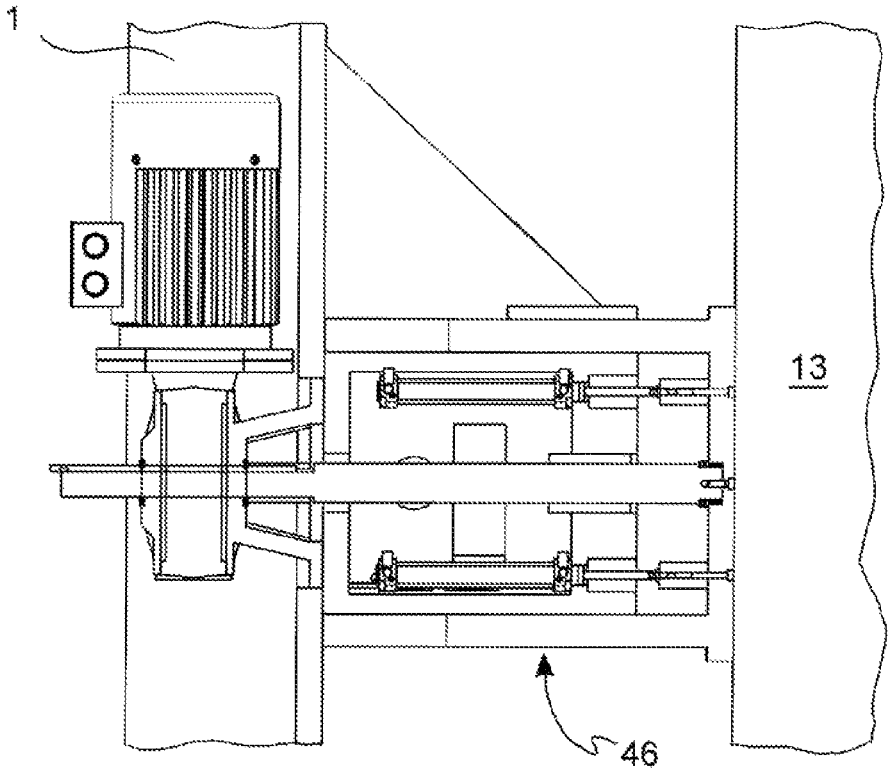
Figure 26:
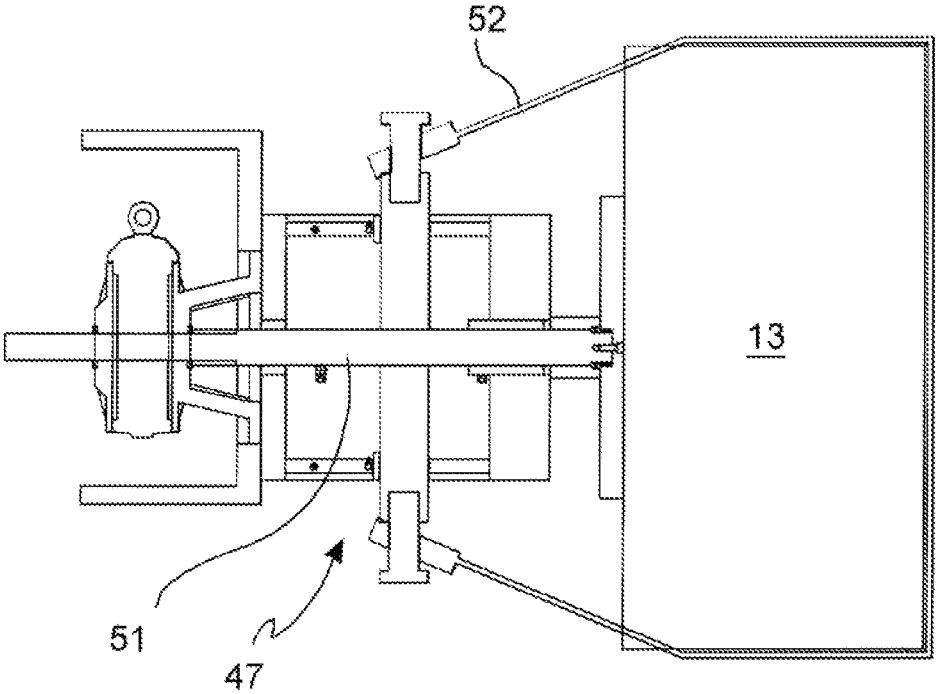
FIGS. 26 and 27 represent two operating steps of a gripper for anchoring to the pillars according to a second embodiment having elements for enclosing the pillar and a thrust element.
Figure 27:
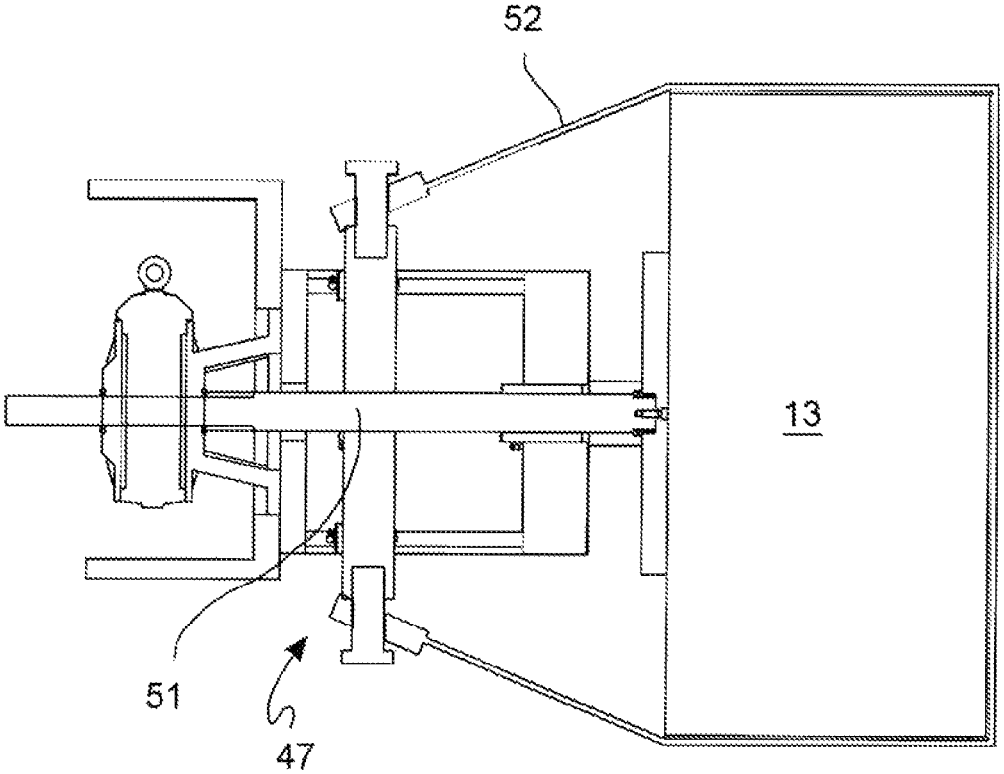
Figure 28:
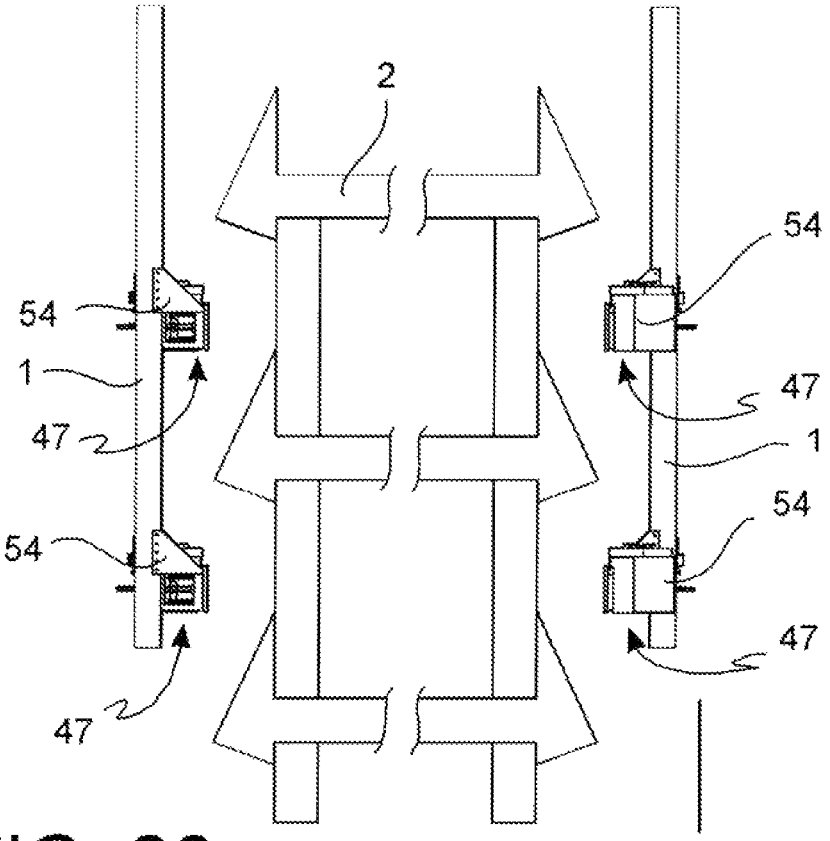
FIG. 28 represents—in sectional view—opposite grippers for anchoring to the pillars in a distanced position to allow descending the platform in case of building facades having projecting portions.
Figure 29:
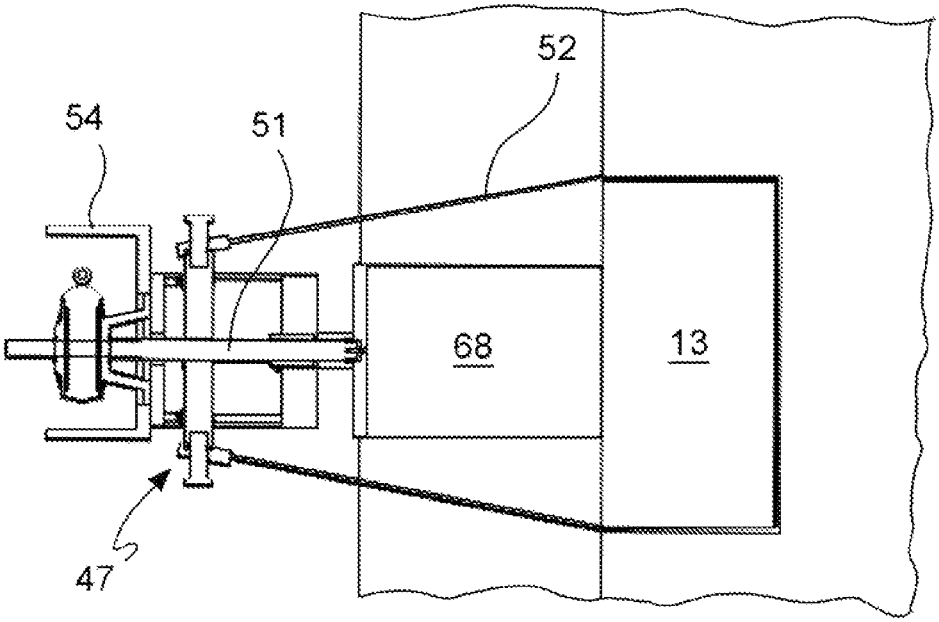
FIG. 29 represents—in sectional view—a gripper for anchoring to the pillars with an enclosing equipment provided with an extension adapted to operate with buildings having portions projecting from the facade of the building.
Figure 30:
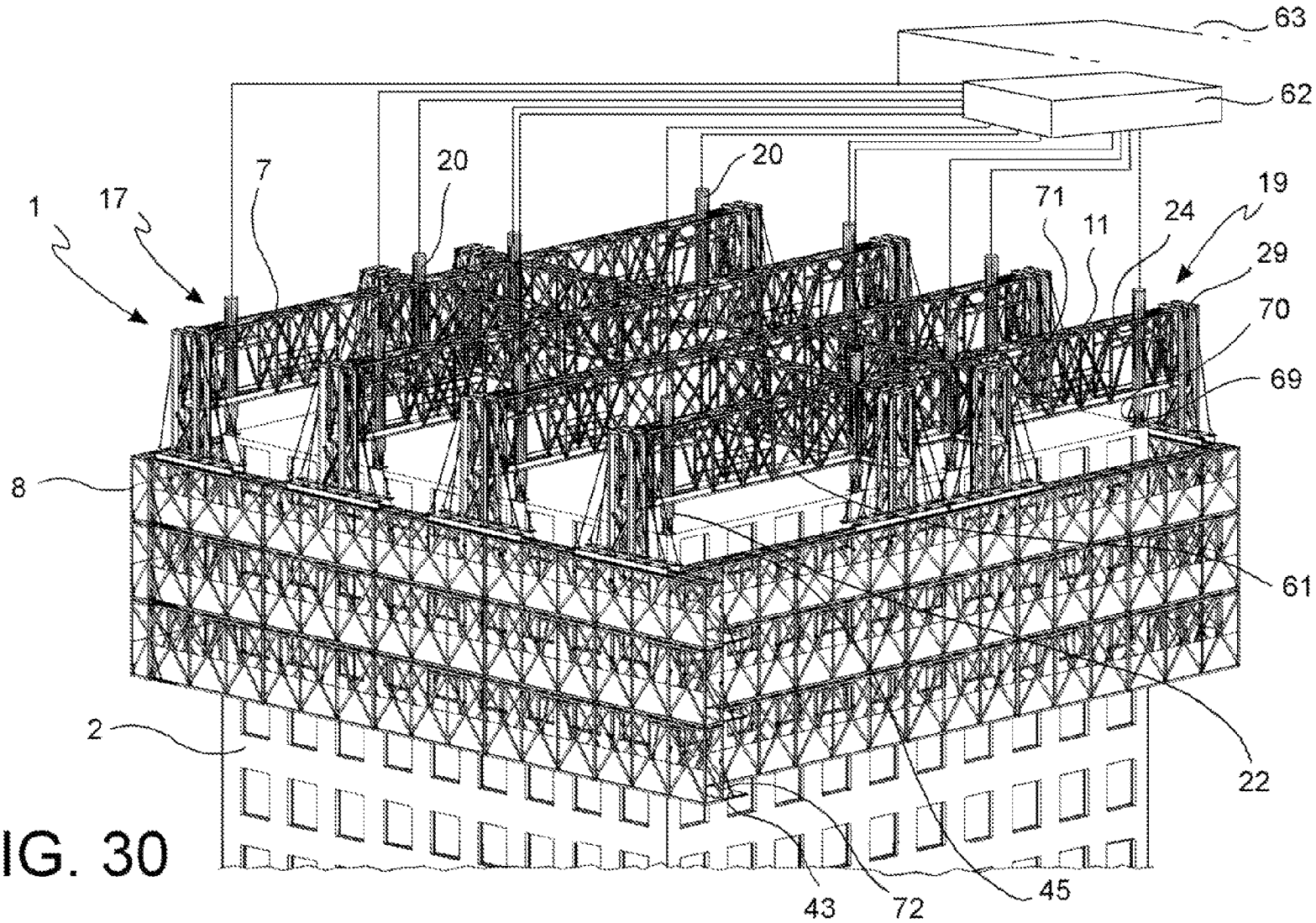
FIG. 30 shows—in partially sectioned axonometric view—the top of a building on which an equipment is placed and in which the adjustment hydraulic and electric connections are schematically indicated.

According to a general embodiment, in the attached figures an equipment 1 for demolishing a building 2 is represented. Said building 2 comprises a building base 3 placed in proximity of a ground 4, or placed on the ground 4, and an opposite building top 5, or temporary building top 5, placed away from said building base 3, as well as building floors 6.

According to an embodiment, said equipment comprises a platform 7 adapted to rest on the building top 5 avoiding ground support devices which from the platform 7 reach the building base 3 or the ground 4 surrounding the building.

According to an embodiment, said equipment 7 comprises at least one working scaffold 8 adapted to be arranged along the periphery 9 of said building 2 and face at least one floor 6 of said building 2.

According to an embodiment, said at least one working scaffold 8 is supported, hanged, on said platform 7 so that it descends along the side wall 10 of the building 2 to confine the works for demolishing the building 2.

According to an embodiment, said equipment 1 comprises at least one main beam 11 adapted to rest on the top, or temporary top, of the building 5 and to support the at least one working scaffold 8.

According to an embodiment, said equipment 1 comprises a plurality of main beams 11 placed at a predefined distance from each other and adapted to rest on the top, or temporary top, of the building 5 and to support, hanged, the at least one working scaffold 8.

According to an embodiment, said plurality of main beams 11 are placed substantially at the top, or temporary top, of pillars 13 of the building.

According to an embodiment, said at least one main beam 11 projects laterally from the top, or temporary top, of the building 5 and supports, hanged, the at least one working scaffold 8.

According to an embodiment, said plurality of main beams 11 are placed substantially at the top 12, or temporary top 12, of pillars 13 of the building.

According to an embodiment, said at least one main beam 11 projects laterally from the top, or temporary top, of the building 5 protruding cantilevered from the periphery of the building 9 to overhang a side wall of the building 10. According to an embodiment, said at least one main beam 11 projects laterally to the building 2 by means of a cantilevered portion thereof of main beam 14.

According to an embodiment, said working scaffold 8 is formed by assembling to each other working scaffold modules 15 having a predefined length, for example 7500 mm. According to an embodiment, said main beam 11 is formed by assembling to each other main beam modules 16, for example having a predefined length, for example 7500 mm.

According to an embodiment, there is provided a device 17 for the adjustment of the arrangement of the main beam 11 positioned on the top, or temporary top, of the building 5 so as to arrange it with resting portions 18 thereof locally facing the top, or temporary top, of the pillars 12 of the building 2. According to an embodiment, said equipment comprises devices 19 for the transverse and longitudinal adjustment of the equipment 1 with respect to the top of the building, or temporary top of the building 5.

According to an embodiment, said equipment 1 comprises a telescopic support device 20 connected to the at least one main beam 11 so as to be interposed between said main beam 11 and the top, or temporary top, of the building, for example on the top of pillars 12 so as to position the main beam 11 by means of such telescopic device 20 on said top, or temporary top, of the pillars 12. According to an embodiment, said telescopic support device 20 has an extension portion 21 which extends so as to cover at least the height of a building floor 6, so as to allow positioning the platform 7 partly on an upper floor being demolished and partly on a lower floor. According to an embodiment, said telescopic support device 20 comprises a cylinder piston unit 22 connected to the at least one main beam 11 and adapted to rest with a slidable stem thereof extendable on the top or head or temporary top or head of pillars 12 and adapted to extend at least of the height of a floor to be demolished so as to be able to rest on the cut top of the pillar of the floor beneath. According to an embodiment, said telescopic support device 20 is connected to at least one main beam 11 by means of a device for adjusting the position of the telescopic support device 24 for adjusting the relative position between said telescopic support device 20 and the at least one main beam 11. According to an embodiment, said device for adjusting the position of the telescopic support device 20 comprises a cylinder piston unit for moving the telescopic support device 20 with respect to the at least one main beam 11.

According to an embodiment, the equipment 1 comprises at least one connection beam 25 placed substantially transverse to the at least one main beam 11 to form a cross support structure 26. According to an embodiment, said at least one main beam 11 and said at least one connection beam 25 rest on the top 12, or the temporary top 12, of the building, for example on the top of pillars 13 arranged along the periphery of the building 9 and/or top 12 of pillars 13 arranged within the top, or temporary top, of the building 5, providing the platform 7 with a plurality of resting points. According to an embodiment, said cross support structure 26 rests on the tops, or temporary tops, of pillars 12 through telescopic support devices 20. According to an embodiment, said cross support structure 26 is directly or indirectly connected through telescopic support devices 20, to at least twelve tops, or temporary tops, of pillars 12 of the building 2.

According to an embodiment, said at least one working scaffold 8 and/or said at least one main beam 11 and/or said at least one connection beam 25 comprise separable portions or modules 15, 16, 27, and/or in which each of said modules 15, 16, 27 has the same longitudinal extension, for example, but not necessarily, of 7500 mm.

According to an embodiment, a scaffold suspension module 28 is provided which connects the at least one main beam 11 and/or the at least one connection beam 25 with the at least one working scaffold 8. According to an embodiment, said at least one scaffold suspension module 28 comprises a structure adapted to enclose a portion of the main beam 11 so as to remain hanged and suspended protruding along the side wall of the building 10 for connecting, for example at the upper part, the at least one working scaffold 8. According to an embodiment, said scaffold suspension module 28 is connected to a cantilevered portion of the main beam 14 and/or to a cantilevered portion of the connection beam 25 which protrudes beyond the periphery of the building 9 to overhang the outside of the side wall of the building 10. According to an embodiment, said scaffold suspension module 28 comprises means 29 for adjusting its connection position to the main beam 11 and/or connection beam 25 so as to adjust the distance of the at least one working scaffold 8 from the side wall of the building 10.

According to an embodiment, said at least one working scaffold 8 forms at least one ring 30, preferably closed and adapted to entirely enclose at least one floor of the building 6. According to an embodiment, said at least one working scaffold 8 comprises separable structural working scaffold modules 31.

According to an embodiment, there is comprised a central under-working scaffold 32 placed beneath the working scaffold 8. According to an embodiment, said central under-working scaffold 32 is connected, hanged, to the working scaffold 8. According to an embodiment, said central under-working scaffold 32 comprises separable modules having a predefined length 33. According to an embodiment, said equipment comprises a further lower under-working scaffold 34 connected to the central under-working scaffold 32. According to an embodiment, said lower under-working scaffold 34 is connected, hanged, on the central under-working scaffold 32. According to an embodiment, said lower under-working scaffold 34 comprises lower under-working scaffold structural modules 35 having a predefined length.

According to an embodiment, said at least one working scaffold 8 and/or central under-working scaffold 32 and/or lower under-working scaffold 34 comprises means for protecting from the fall of material 36 from the platform 7. According to an embodiment, said means for protecting from the fall of the material 36 comprise a vertical barrier 37 for protecting from the fall of materials from the scaffold placed on the periphery 38 of the at least one working scaffold 8 and/or central under-working scaffold 32 and/or lower under-working scaffold 34.

According to an embodiment, said working scaffold 8 and/or central under-working scaffold 32 and/or lower under-working scaffold 34 comprises a lower fixed walkway plane 39. According to an embodiment, said fixed walkway plane 39 is placed at a distance, or interspace 44, from the side wall of the building 10 by an extension sufficient for removing the glass panels of the building 40, for example towards the outside of the building and the lifting thereof towards the top of the building, or temporary top of the building 5 passing between the fixed plane 39 and the side wall of the building 10 of the overhanging working scaffolds 32 and/or 8. According to an embodiment, to said fixed plane 39 a movable plane 41 is movably connected, which projects from said fixed plane 39 towards the side wall of the building 10. According to an embodiment, said movable plane 41 comprises flexible or elastic sealing means 42 adapted to sealingly rest on the side wall of the building 10 to prevent the inadvertent fall of material. According to an embodiment, there are provided devices for opening planes 43 adapted for the controlled movement of the movable planes 41 for the movement thereof from an extended position towards the side wall of the building 10 to a retracted or folded position to open the interspace 44 present between the fixed walkway plane 39 and the side wall of the building 10. According to an embodiment, said device for opening planes 43 comprises a plane cylinder piston unit 45 adapted to automatically move the movable plane 41 from its extended walkway position to its retracted or open position which frees the interspace 44.

According to an embodiment, to said working scaffold 8 and/or central under-working scaffold 32 and/or lower under-working scaffold 34 at least one side support piston 46 of the equipment 1 is associated to the side wall of the building 10. According to an embodiment, said equipment 1 comprises at least two side support pistons 46 opposite to each other with respect to the building 2 to avoid lateral movements of the platform with respect to the building 2. According to an embodiment, said equipment 1 comprises at least four side support pistons 46 arranged two by two with transverse actions with respect to each other so as to prevent the lateral movement of the platform according to any direction transverse or orthogonal to the longitudinal extension of the building in height.

Due to the provision of at least one side support piston of the equipment and preferably two opposite support pistons, the equipment is unusually adapted to also bear particularly serious atmospheric events and even earthquakes.

According to an embodiment, there is provided at least one gripper 47 for anchoring to the pillars 13 adapted to connect the equipment 1 to the structure of a building pillar 13. According to an embodiment, said at least one gripper 47 for anchoring to the pillars comprises a device 48 for inserting a pin 49 within a hole 50 made transversely to the longitudinal extension of the building pillar 13. According to an embodiment, said gripper 47 for anchoring to the pillars comprises a cylinder and piston device adapted to move said anchoring gripper 47 away from the building pillar 13 and further comprises means 52 for enclosing the pillar adapted to transversely enclose the structure of the building pillar and prevent moving the equipment away from the building pillar, blocking the movements of the equipment with respect to the building. According to an embodiment, said gripper 47 for anchoring to the pillars comprises clamps 53 adapted to open and close for stable anchorage to the structure of the building pillar 13.

Due to the provision of at least one anchoring gripper, the equipment is even more adapted to also bear particularly serious atmospheric events and even earthquakes.

According to an embodiment, said at least one gripper 47 for anchoring to the pillars is supported on a foldable structure moving away from the side wall of the building 10 to free the interspace 44 present between the equipment 1 and the building 2 and allow moving the platform or the passage of materials between the scaffolds and the facade of the building.

According to an embodiment, said equipment 1 has side protection barriers 55 to avoid the fall of debris from the equipment, for example from the main beams or connection beams or from the scaffolds.

According to an embodiment, said protection barriers comprise acoustic insulation panels 56.

According to an embodiment, the equipment comprises separate demolition means 56 capable of operating independently from the platform 7 and/or from the scaffolds 8, 32, 34 and movable with respect to said platform 7 and/or scaffolds 8, 32, 34.

According to an embodiment, said equipment comprises reinforcement struts 58 adapted to be inserted between two floors of the building for reinforcing the support floor or floor of the upper floor to be demolished 56. According to an embodiment, said struts 58 are arranged in the floor 60 beneath the one to be demolished for reinforcing the upper floor 59 so as to be able to support demolition means of the building 57 also having weight greater than the resistance limit of the support floor or floor of the upper floor to be demolished 59. According to an embodiment, said equipment comprises reinforcement struts 58 adapted to be inserted for reinforcing the support floor or floor of the upper floor to be demolished 59 and arranged in the lower floor and in the floor beneath the lower one with respect to the one to be demolished, for reinforcing the upper floor.

According to an embodiment, a hydraulic circuit is provided having ports capable of atomizing fluid, for example water, for reducing the demolition dust while avoiding flooding or even excessive presence of fluid in the equipment thus avoiding hindering the demolition work. According to an embodiment, said atomizer ports are automatically controlled to be able to concentrate the fluid, for example the atomized water, in the areas of interest alone.

According to an embodiment, some or all the devices for moving the equipment are controllably driven by a platform movement control device 62.

According to an embodiment, said device for adjusting and positioning the main beam 17 and/or said longitudinal and transverse adjustment device at the top of the building 19 and/or said telescopic support device 20 and/or said cylinder piston unit 22 and/or said device for adjusting the telescopic device 24 and/or said means for adjusting the positioning of the scaffold suspension module 29 and/or said device for opening of the plane 43 and/or said cylinder piston unit of the movable plane 54 and/or said piston for lateral support on the building 46 and/or said gripper 47 for anchoring to the pillars and/or said hydraulic circuit with dust reduction atomizer ports 61 are driven in a controlled manner and/or with feedback, for example by providing opening sensors or position sensors with feedback on the actuation control. According to an embodiment, said hydraulic circuit with dust reduction atomizer ports 61 is controlled so as to modify the atomization direction and intensity and/or the atomization area. According to an embodiment, in said equipment 1 a control room 63 is comprised in which there are provided display means 64 and control means 65 for controlling the operation of the equipment and/or controlling and/or adjusting all the movements of the equipment 1.

According to an embodiment, the outer surface of the equipment forms an external support for advertisement means 66.

According to an embodiment, laterally to the platform there is comprised a lifter or lateral support crane 67 placed on the ground 4 in proximity of the base of the building 3.

A possible method of operation of the above described equipment is described hereinafter.

According to a possible general operation type, a method for demolishing a building 2, which building comprises a building base 3 arranged in proximity of a ground 4, or arranged in the ground 4, and comprises an opposite top, or temporary top of the building 5, arranged away from said building base 3, as well as building floors 6, said method comprises the following steps:

positioning on the top, or temporary top, of the building 5 a platform 7, avoiding devices for supporting the platform on the ground, which from the platform reach the base of the building or the ground surrounding the building;

arranging along the periphery 9 of said building and opposite to at least one floor of said building 6 at least one working scaffold 8;

supporting, hanging on said platform 7, said at least one working scaffold 8 so that it descends along the side wall of the building 10 to border the works for demolishing the building.

According to an operating method, said method comprises the further steps of associating said platform 7 to the top 12, or temporary top 12, of pillars 13 of the building 2. According to an operating method, said method comprises the further step of demolishing a floor of the building 6 arranged in proximity of the top of the building 5.

According to an operating method, said method comprises the step of lifting the platform from a single pillar 13 allowing the demolition of this single pillar 13 at least over the extension of a building floor 6 thereof.

According to an operating method, said method comprises a further step which provides that—as the pillars 13 of the building are progressively demolished over the extension regarding the last temporary floor of the building to be demolished 59—the platform is supported on the temporary head or temporary top of the pillar 12 demolished at the height of the floor 60 beneath the floor to be demolished 59.

According to an operating method, said method comprises the step of descending, upon completing the demolition of the floor to be demolished 59, the platform 7 of a height equal to the demolished floor 59 alongside at least one working scaffold 8 hanged thereto.

According to an operating method, said method comprises the step of positioning the platform 7 with main beams 11 and/or connection beams 25 on the top or temporary top of the building 5.

According to an operating method, said method comprises the step of protecting the periphery 9 of the top of the building or temporary top of the building 5 over an extension equal to at least one building floor 6 descending from the top of the building 5 by means of a working scaffold 8, so as to avoid the fall of debris and/or the spread of noise and/or to allow the removal of parts of the building from the outside of the building, for example building windows or glass panels 40.

According to an operating method, said method comprises the step of protecting the periphery of the top of the building for at least two and/or three building floors 6 so as to allow working on the floor proximal to or beneath the top of the building by demolishing the building floor while demounting the removable parts of the building in the underlying floors.

According to an operating method, said method comprises the step of adjusting the position of the main beam 11 or connection beam 25 or telescopic means for supporting the platform 20 to the top of the building 5 depending on the position of the top or temporary top of the building pillar 12.

According to an operating method, said method comprises the step of adjusting the position of the scaffold suspension module 28 with respect to the at least one main beam 11 or the at least one connection beam 25.

According to an operating method, said method comprises the step of demolishing a floor of the building with separate demolition means 57, means which are separate and independent from the equipment 1 and/or from the platform 7.

According to an operating method, said method comprises, while demolishing a floor of the building 6, the step of demounting the windows or glass panels of the floor 60 beneath and evacuating the debris or pieces of building by means of an under-working scaffold 32 or 34.

According to an operating method, said method comprises the step of using the elevator compartment, emptied from the elevator, as means for evacuation of the debris up to the base of the building.

According to an operating method, said method comprises the step of using a hydraulic system with ports for atomizing fluids, for example water, for reducing the demolition dust.

According to an operating method, said method comprises the step of propping up at least one lower floor 60, and/or two lower floors, on the floor to be demolished 59 by means of reinforcement struts 58 of the floor of the building adapted to support demolition means 57 arranged on the floor to be demolished also having a weight greater than the limit weight which can be supported by the floor of the floor to be demolished.

According to an operating method, said method comprises the step of countering the lateral movement of the platform and/or of the equipment by exerting at least one pressure, and/or two opposite lateral pressures acting from the equipment against the side wall of the building 10, for example from a working scaffold 8.

According to an operating method, said method comprises the step of controlling the movements of the equipment and/or of the platform by means of a centralised and/or feedback adjustment.

According to an operating method, said method comprises the step of evacuating materials not to be demolished locally by using a crane 67 arranged laterally in proximity of the base of the building up to the top of the building. According to an operating method, said method comprises the step of mounting and/or demounting the platform by using a crane 67 arranged laterally in proximity of the base of the building up to the top of the building.

According to an embodiment, some or all the devices for moving the equipment, such as for example:

the device for adjusting the main beam position and/or the longitudinal and transverse adjustment devices on building top and/or the telescopic support device and/or the cylinder piston unit and/or device for adjusting the telescopic device and/or the means for adjusting the position of the scaffold suspension module and/or the device for opening the plane and/or cylinder piston unit of the movable plane and/or the pistons for the lateral support on the building and/or the gripper for anchoring to the pillars and/or the gripper cylinder piston unit and/or the pillar gripping clamps and/or the hydraulic circuit with dust reduction atomizer ports are controllably driven by a platform movement control device (62), for example but not necessarily, feeding back the signal by means of measurements performed using load cells and/or displacement sensors—such as for example LVDT, and/or inclination sensors.

According to an embodiment, said device for adjusting and positioning the main beam 17 and/or said longitudinal and transverse adjustment device on building top 19 and/or said telescopic support device 20 and/or said cylinder piston unit 22 and/or said device for adjusting the telescopic device 24 and/or said means for adjusting the positioning of the scaffold suspension module 29 and/or said device for opening a plane 43 and/or said cylinder piston unit of the movable plane 54 and/or said lateral support piston of the building 46 and/or said gripper 47 for anchoring to the pillars and/or said hydraulic circuit with dust reduction atomizer ports 61, are driven in a controlled manner and/or with feedback, for example by providing opening sensors 72 and/or position or displacement sensors 72 and/or load sensors 69 and/or pressure sensors and/or inclination sensors 71—for example, but not necessarily, arranged on the at least one main beam or on a scaffold—feedback on the actuation control, and/or in which said hydraulic circuit with dust reduction atomizer ports 61 is controlled so as to modify the atomization direction and intensity and/or the atomization area, and/or in which in said equipment 1 a control room 63 is comprised in which there are provided display means 64 and control means 65 for controlling and/or adjusting all the movements of the platform 7.

The preferred embodiment of the device described above may be subjected, by a man skilled in the art with the aim of meeting contingent and specific needs, to numerous modifications adaptations and replacement of elements with other functionally equivalent elements, without departing from the scope of the following claims.

| REFERENCES | |
|---|---|
| 1 | Equipment |
| 2 | Building |
| 3 | Building base |
| 4 | Ground |
| 5 | Building top or temporary building top |
| 6 | Building floor |
| 7 | Platform |
| 8 | Working scaffold |
| 9 | Periphery of the building |
| 10 | Side wall of the building |
| 11 | Main beam |
| 12 | Top or temporary top of pillars |
| 13 | Building pillars |
| 14 | Main beam cantilevered portion |
| 15 | Working scaffold modules |
| 16 | Main beam modules |
| 17 | Device for adjusting the main beam position |
| 18 | Main beam portion for positioning on the pillar |
| 19 | Longitudinal and transverse adjustment devices on building top |
| 20 | Telescopic support device |
| 21 | Telescopic device extension portion |
| 22 | Cylinder piston unit |
| 23 | Cylinder piston unit stem |
| 24 | Device for adjusting the telescopic device |
| 25 | Connection beam |
| 26 | Cross support structure |
| 27 | Connection beam module |
| 28 | Scaffold suspension module |
| 29 | Means for adjusting the position of the scaffold suspension module |
| 30 | Working scaffold ring surrounding the building |
| 31 | Working scaffold structural module |
| 32 | Central under-working scaffold |
| 33 | Central under-working scaffold structural module |
| 34 | Lower under-working scaffold |
| 35 | Lower under-working scaffold structural module |
| 36 | Fall protection means |
| 37 | Working scaffold vertical barrier |
| 38 | Working scaffold outer periphery |
| 39 | Fixed walkway plane |
| 40 | Building glass panels |
| 41 | Movable plane |
| 42 | Movable plane sealing means |
| 43 | Device for opening the plane |
| 44 | Interspace between fixed plane and building side wall |

-continued

| REFERENCES | |
|---|---|
| 45 | Movable plane cylinder piston unit |
| 46 | Pistons for the lateral support on the building |
| 47 | Gripper for anchoring to the pillars |
| 48 | Pin insertion device |
| 49 | pin |
| 50 | Pillar hole |
| 51 | Gripper cylinder piston unit |
| 52 | Pillar enclosing means |
| 53 | Pillar gripping clamps |
| 54 | Foldable support structure for anchorage gripper |
| 55 | Barriers for lateral protection from debris fall |
| 56 | Acoustic insulation panels |
| 57 | Demolition means separated from platform |
| 58 | Building floor reinforcement struts |
| 59 | Floor to be demolished |
| 60 | Floor beneath a floor to be demolished |
| 61 | Hydraulic circuit with dust reduction atomizer ports |
| 62 | Platform control device |
| 63 | Control room |
| 64 | Means for displaying movements and/or adjustments |
| 65 | Means for adjusting the movements of the platform |
| 66 | Advertisement means |
| 67 | Lateral crane |
| 68 | Thrust extension |
| 69 | Load cell and/or pressure sensors |
| 70 | position or displacement sensors - for example LVDT |
| 71 | Inclination sensor |
| 72 | Opening/closing sensors |

The invention claimed is:

1. Equipment for demolishing a building, said building comprising a building base placed in proximity of a ground, or placed on the ground, and a building top, or temporary building top, disposed away from and opposite to said building base, as well as building floors, said equipment comprising:

a platform adapted to rest on the top of the building without any ground support devices supporting the platform from the base of the building or from the ground surrounding the building, said platform comprising:

a plurality of main beams placed at a predefined distance to each other and adapted to rest on the top, or temporary top, of the building as the building is being demolished from top to bottom, said plurality of main beams being placed on top of building pillars and having ends protruding cantilevered from the periphery of the building to overhang a side wall of the building; and at least one working scaffold adapted to be arranged along the periphery of said building and face at least one floor of said building, said at least one working scaffold being supported by and hung from the overhanging ends of the main beams so as to avoid a compression load on the scafford, such that the scaffold descends along the side wall of the building adjacent to works for demolishing the building;

a telescopic placement device connected to at least one of said main beams, so as to be interposed between said at least one main beam and the top, or temporary top, of the pillars, for adjustment of an arrangement of the platform positioned on the top, or temporary top, of the building, said telescopic placement device having positioning portions facing the top, or temporary top, of the pillars of the building, wherein said telescopic placement device is connected to the main beam by a device for adjusting the relative position between said telescopic placement device and the main beam, said device for adjusting the position of the telescopic placement device comprising a cylinder piston unit for moving the telescopic placement device with respect to the main beam, said telescopic placement device being driven in a controlled manner with feedback using sensors arranged on said at least one main beam or on said working scaffold.

2. Equipment, according to claim 1, wherein said working scaffold is formed by assembling working scaffold modules having a predefined length.

3. Equipment, according to claim 1, wherein said telescopic placement device has an extension portion which extends so as to cover at least a height of a building floor, so as to allow the platform to be positioned partly on an upper floor being demolished and partly on a lower floor.

4. Equipment, according to claim 1, wherein said at least one working scaffold forms at least one ring, closed and adapted to entirely surround at least one floor of the building, wherein said at least one working scaffold comprises working scaffold separable structural modules; wherein a central under-working scaffold is disposed beneath the at least one working scaffold, wherein:

said central under-working scaffold is hung from the working scaffold, wherein said central under-working scaffold comprises separable structural modules having a predefined length, said equipment comprises a further lower under-working scaffold connected to the central under-working scaffold, said lower under-working scaffold is hung from the central under-working scaffold, and said lower under-working scaffold comprises lower under-working scaffold structural modules having a predefined length.

5. Equipment according to claim 4, wherein said at least one working scaffold and said central under-working scaffold and said lower under-working scaffold comprise means for protecting from a fall of material from the equipment, and wherein said means for protecting from the fall of the material comprise a vertical barrier for protecting from the fall of materials placed on the periphery of the at least one working scaffold, the central under-working scaffold or the lower under-working scaffold;

said working scaffold and said central under-working scaffold and said lower under-working scaffold comprise a lower fixed walkway plane, and wherein said fixed walkway plane is placed at a distance from the side wall of the building sufficient for removing glass panels of the building and lifting the glass panels towards the top of the building, or temporary top of the building, passing between the fixed walkway plane and the side wall of the building, a movable plane is movably connected to the fixed walkway plane, the movable plane projecting from said fixed walkway plane towards the side wall of the building and wherein said movable plane comprises flexible or elastic sealing means adapted to be sealingly positioned on the side wall of a building to prevent the inadvertent fall of material, devices for opening planes are provided for controlled movement of the movable plane from an extended position towards the side wall of the building to a retracted or folded position for opening a space between the walkway plane and the side wall of the building, said device for opening planes comprises a plane cylinder piston unit adapted to automatically move the movable plane from an extended walkway position to a retracted or open position which creates the space.

6. Equipment, according to claim 4, wherein at least two lateral support pistons, disposed opposite to each other, are associated with at least one of said working scaffold, said central under-working scaffold and said lower under-working scaffold to avoid lateral movements of the platform with respect to the building.

7. Equipment, according to claim 1, further comprising separate demolition means capable of operating independently from the platform and movable with respect to said platform, wherein said equipment comprises reinforcement struts for reinforcing an upper floor to be demolished, the reinforcement struts being arranged in a floor beneath the upper floor to be demolished for reinforcing the upper floor so as to be able to support demolition means.

8. Equipment, according to claim 1, wherein said equipment further comprises devices for transverse and longitudinal adjustment of the platform with respect to the top of the building, or temporary top of the building.

9. Equipment, according to claim 1, wherein said telescopic placement device has an extension portion which extends so as to cover at least a height of a building floor, so as to allow positioning the platform partly on an upper floor being demolished and partly on a lower floor.

10. Equipment, according to claim 1, wherein said cylinder piston unit of said telescopic placement device is connected to the at least one main beam and adapted to be positioned with a slidable stem thereof extendable on the top of the pillars.

11. Equipment, according to claim 1, further comprising at least one connection beam arranged substantially transverse to the at least one main beam to form a cross support structure.

12. Equipment, according to claim 11, wherein said at least one main beam and said at least one connection beam are positioned on the top, or the temporary top, of the pillars which are arranged along the periphery of the building or the pillars which are arranged within the top, or temporary top, of the building, providing a plurality of points for supporting the platform.

13. Equipment, according to claim 11, wherein said cross support structure rests on the top, or temporary tops, of the pillars through other of said telescopic placement device, and wherein said cross support structure is directly or indirectly connected through said other telescopic placement device, to at least twelve tops, or temporary tops, of the pillars of the building.

14. Equipment, according to claim 11, wherein said at least one working scaffold, said at least one main beam, or said at least one connection beam comprise separable portions or modules, and wherein each of said modules has a same longitudinal extension.

15. Equipment, according to claim 14, further comprising a scaffold suspension module which connects the at least one main beam or the at least one connection beam with the at least one working scaffold, said at least one scaffold suspension module comprising a structure adapted to enclose a portion of the main beam so as to remain hung and protruding along the side wall of the building for connecting, the at least one working scaffold.

16. Equipment, according to claim 15, wherein said scaffold suspension module is connected to the cantilevered portion of the main beam or to a cantilevered portion of the connection beam which projects beyond the periphery of the building to overhang an outside of the side wall of the building.

17. Equipment, according to claim 15, wherein said scaffold suspension module comprises means for adjusting a connection position of the suspension module to the main beam or connection beam so as to adjust a distance of the at least one working scaffold from the side wall of the building.

18. Equipment, according to claim 1, further comprising a hydraulic circuit having ports for atomizing fluid adapted to reduce demolition dust, wherein said hydraulic circuit with dust reduction atomizer ports is controlled so as to modify the atomization direction and intensity or atomization area, and a control room is provided, the control room comprising platform.

19. Equipment, according to claim 1, wherein main beam is formed by assembling main beam modules.

* * * * *